US010608324B2

(12) United States Patent
Lee et al.

(10) Patent No.: US 10,608,324 B2
(45) Date of Patent: Mar. 31, 2020

(54) ELECTRONIC DEVICE COMPRISING ANTENNA

(71) Applicant: Samsung Electronics Co., Ltd., Gyeonggi-do (KR)

(72) Inventors: Sang Ha Lee, Gyeonggi-do (KR); Kyung Jae Lee, Seoul (KR); Jae Ho Lim, Gyeonggi-do (KR); Dong Hwan Kim, Gyeonggi-do (KR); Young Jun Kim, Gwangju (KR); Un Kim, Gyeonggi-do (KR); Jong Hoon Kim, Gyeonggi-do (KR); Min Seok Park, Seoul (KR)

(73) Assignee: Samsung Electronics Co., Ltd. (KR)

( * ) Notice: Subject to any disclaimer, the term of this patent is extended or adjusted under 35 U.S.C. 154(b) by 96 days.

(21) Appl. No.: 15/720,872

(22) Filed: Sep. 29, 2017

(65) Prior Publication Data

US 2018/0090821 A1 Mar. 29, 2018

(30) Foreign Application Priority Data

Sep. 29, 2016 (KR) ..... 10-2016-0125917

(51) Int. Cl.
*H01Q 1/24* (2006.01)
*H01Q 1/38* (2006.01)
(Continued)

(52) U.S. Cl.
CPC ..... *H01Q 1/243* (2013.01); *H01Q 1/38* (2013.01); *H01Q 5/328* (2015.01); *H01Q 5/35* (2015.01);
(Continued)

(58) Field of Classification Search
CPC ..... H01Q 1/243; H01Q 9/42; H01Q 5/35; H01Q 5/40; H01Q 1/38; H01Q 5/328; H01Q 9/04; H01Q 13/10
See application file for complete search history.

(56) References Cited

U.S. PATENT DOCUMENTS 8,648,752 B2 2/2014 Ramachandran et al.
9,172,139 B2 10/2015 Pascolini et al.
(Continued)

FOREIGN PATENT DOCUMENTS

EP 2 498 336 9/2012
EP 2 858 172 4/2015
KR 1020140037687 3/2014

OTHER PUBLICATIONS international Search Report dated Jan. 17, 2018 issued in counterpart application No. PCT/KR2017/010973, 11 pages.
(Continued)

*Primary Examiner* — Hai V Tran
*Assistant Examiner* — Michael M Bouizza
(74) *Attorney, Agent, or Firm* — The Farrell Law Firm, P.C.

(57) ABSTRACT

An electronic device includes a metal housing, a conductive member disposed adjacent to the metal housing, a plurality of ground parts including a first ground part electrically connected with a first point of the conductive member and a second ground part electrically connected with a second point of the conductive member, a ground plate electrically connected with the metal housing and electrically connected with the conductive member via the plurality of ground parts, and a feeding part electrically connected with the conductive member.

16 Claims, 15 Drawing Sheets

(51) Int. Cl.

| | |
|---|---|
| ***H01Q 13/10*** | (2006.01) |
| ***H01Q 5/328*** | (2015.01) |
| ***H01Q 9/04*** | (2006.01) |
| ***H01Q 5/35*** | (2015.01) |
| ***H01Q 5/40*** | (2015.01) |
| ***H01Q 9/42*** | (2006.01) |

(52) U.S. Cl.
CPC ..... *H01Q 5/40* (2015.01); *H01Q 9/04* (2013.01); *H01Q 9/42* (2013.01); *H01Q 13/10* (2013.01)

(56) References Cited

U.S. PATENT DOCUMENTS

| | | | |
|---|---|---|---|
| 9,667,296 | B2 | 5/2017 | Kim et al. |
| 9,673,507 | B2 | 6/2017 | Ramachandran et al. |
| 9,716,307 | B2 | 7/2017 | Tsai et al. |
| 9,728,854 | B2 | 8/2017 | Kim et al. |
| 9,755,298 | B2 | 9/2017 | Chol et al. |
| 2010/0090921 | A1 | 4/2010 | Kim et al. |
| 2011/0133995 | A1 | 6/2011 | Pascolini et al. |
| 2012/0206302 | A1 | 8/2012 | Ramachandran et al. |
| 2012/0229347 | A1 | 9/2012 | Jin et al. |
| 2014/0078008 | A1 | 3/2014 | Kang et al. |
| 2014/0125528 | A1 | 5/2014 | Tsai et al. |
| 2014/0225787 | A1 | 8/2014 | Ramachandran et al. |
| 2014/0300518 | A1 | 10/2014 | Ramachandran et al. |
| 2015/0048979 | A1 | 2/2015 | Asrani et al. |
| 2015/0084817 | A1* | 3/2015 | Yong ..... H01Q 1/243 343/702 |
| 2016/0064820 | A1 | 3/2016 | Kim et al. |
| 2016/0182112 | A1 | 6/2016 | Kim et al. |
| 2016/0197396 | A1 | 7/2016 | Choi et al. |
| 2017/0054200 | A1 | 2/2017 | Kang et al. |
| 2017/0256845 | A1 | 9/2017 | Tsai et al. |
| 2017/0256846 | A1 | 9/2017 | Tsai et al. |

OTHER PUBLICATIONS

European Search Report dated Apr. 1, 2019 issued in counterpart application No. 17856833.3-1205, 9 pages.

* cited by examiner

ELECTRONIC DEVICE COMPRISING ANTENNA

PRIORITY

This application claims priority under 35 U.S.C. § 119(a) to Korean Application Serial No. 10-2016-0125917, which was filed in the Korean Intellectual Property Office on Sep. 29, 2016, the entire content of which is incorporated herein by reference.

BACKGROUND

1. Field of the Disclosure

The present disclosure relates to improving radiation performance of an antenna resonant element included in an electronic device.

2. Description of the Related Art

An electronic device such as a smartphone, a tablet, and the like may communicate with a network by using an antenna. An electronic device's antenna may be formed with a conductive material. To improve a design of the electronic device, a side surface of the electronic device may be implemented with a metal frame. The metal frame may be used as an antenna resonant element.

Meanwhile, to improve the design of the electronic device, a rear housing of the electronic device may be formed of metal. In this case, a nonconductive member may be interposed between the metal frame and the rear housing such that the metal frame and the rear housing used as the antenna resonant element are electrically separated from each other.

In the case where a metal housing is applied to a rear surface of an electronic device and a metal frame is applied to a side surface of the electronic device, a distance between the metal frame and the metal housing may become close to each other. Even though a nonconductive member is disposed between the metal frame and the metal housing, the metal frame may be electrically coupled with the metal housing. If the metal frame and the metal housing are electrically coupled, radiation performance of the metal frame used as an antenna resonant element may be reduced.

SUMMARY

Aspects of the present disclosure are to address at least the above-mentioned problems and/or disadvantages and to provide at least the advantages described below. Accordingly, an aspect of the present disclosure is to improve performance of an antenna resonant element adjacent to a metal housing.

In accordance with an aspect of the present disclosure, an electronic device includes a metal housing, a conductive member disposed adjacent to the metal housing, a plurality of ground parts including a first ground part electrically connected with a first point of the conductive member and a second ground part electrically connected with a second point of the conductive member, a ground plate electrically connected with the metal housing and electrically connected with the conductive member via the plurality of ground parts, and a feeding part electrically connected with the conductive member.

In accordance with another aspect of the present disclosure, an electronic device includes a metal housing, a nonconductive member being in contact with the metal housing, a conductive member being in contact with the nonconductive member, spaced apart from the metal housing by the nonconductive member, and electrically coupled with the metal housing, a plurality of ground parts including a first ground part electrically connected with a first point of the conductive member and a second ground part electrically connected with a second point of the conductive member, a ground plate electrically connected with the metal housing and electrically connected with the conductive member via the plurality of ground parts, and a feeding part electrically connected with the conductive member.

In accordance with another aspect of the present disclosure, an electronic device includes a metal housing in which a slot is formed, a printed circuit board disposed in parallel with the metal housing, wherein a partial region of the printed circuit board corresponding to the slot being formed of a nonconductive material, a plurality of electrical paths including a first electrical path and a second electrical path, wherein the first electrical path connects a first point of the printed circuit board adjacent to the partial region of the printed circuit board and a first point of the metal housing adjacent to the slot of the metal housing and the second electrical path connects a second point of the printed circuit board adjacent to the partial region of the printed circuit board and a second point of the metal housing adjacent to the slot of the metal housing, a switch disposed on the second electrical path and configured to adjust making and breaking of the second electrical path, a ground plate electrically connected with the metal housing and the printed circuit board, and a feeding part electrically connected with the first point of the printed circuit board.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers may be used to depict the same or similar elements, features, and structures.

DETAILED DESCRIPTION

Figure 1:
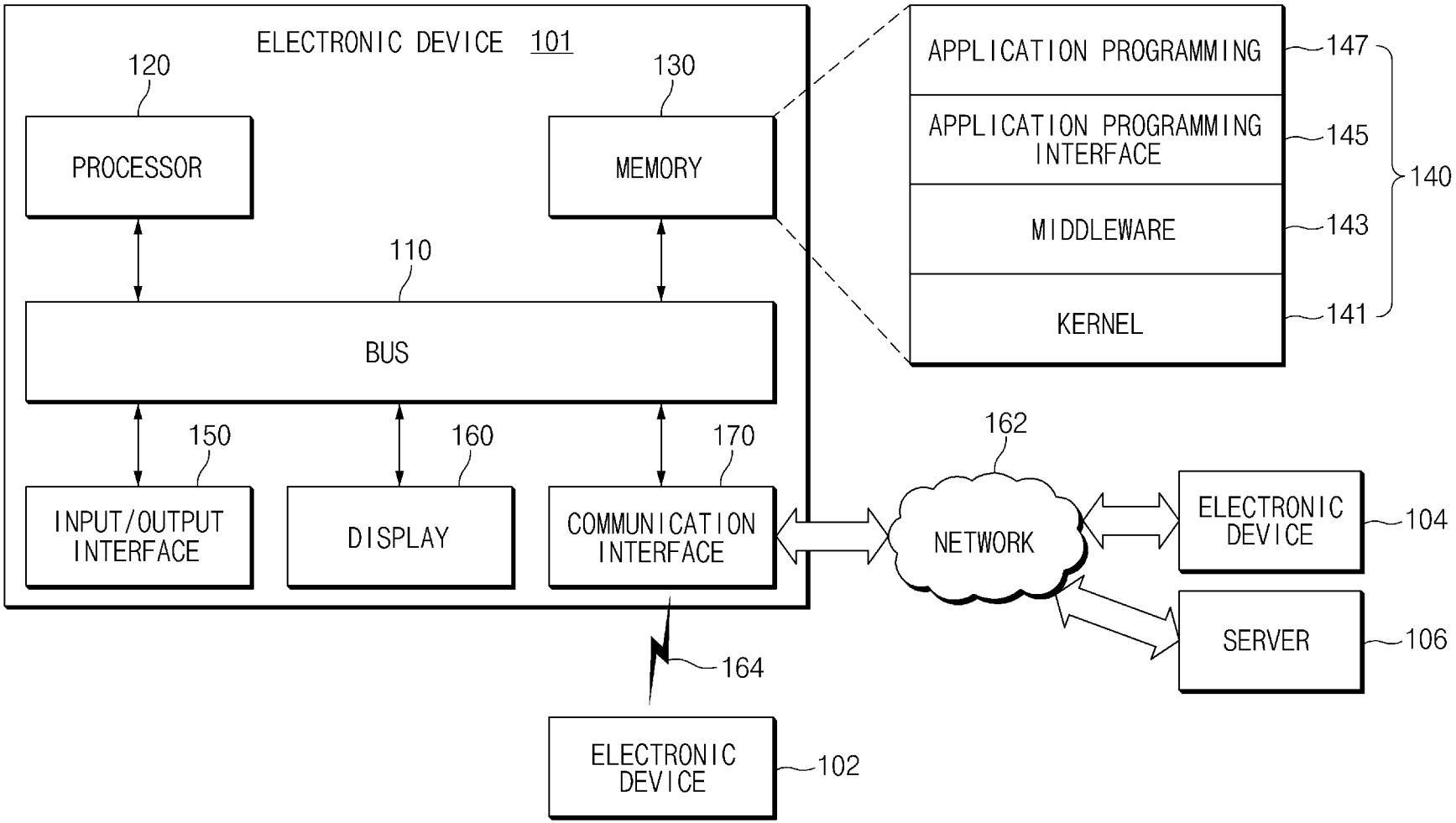
FIG. 1 is a block diagram of an electronic device in a network environment according to various embodiments of the present disclosure.

Hereinafter, various embodiments of the present disclosure may be described with reference to accompanying drawings. Accordingly, those of ordinary skill in the art will recognize that modifications, equivalents, and/or alternatives of the various embodiments described herein can be made without departing from the scope and spirit of the present disclosure. With regard to description of drawings, similar elements may be marked by similar reference numerals. The terms of a singular form may include plural forms unless otherwise specified. In this present disclosure, the expressions "A or B", "at least one of A or/and B", or "one or more of A or/and B", and the like may include any and all combinations of one or more of the associated listed items. Terms, such as "first", "second", and the like may be used to refer to various elements regardless of the order and/or the priority and to distinguish the relevant elements from other elements, but do not limit the elements. When an element (e.g., a first element) is referred to as being "(operatively or communicatively) coupled with/to" or "connected to" another element (e.g., a second element), the element may be directly coupled with/to or connected to the other element or an intervening element (e.g., a third element) may be present.

According to the situation, the expression "configured to" used in this present disclosure may be interchangeably used with the expressions "suitable for", "having the capacity to", "adapted to", "made to", or "capable of", or "designed to" in hardware or software. The expression "a device configured to" may mean that the device is "capable of" operating together with another device or other components. A "processor configured to (or set to) perform A, B, and C" may mean a dedicated processor (e.g., an embedded processor) for performing a corresponding operation or a generic-purpose processor (e.g., a central processing unit (CPU) or an application processor (AP)) which performs corresponding operations by executing one or more software programs which are stored in a memory device.

An electronic device according to various embodiments of the present disclosure may include smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, medical devices, cameras, and wearable devices. The wearable device may include an accessory type (e.g., watches, rings, bracelets, anklets, necklaces, glasses, contact lens, and head-mounted-devices (HMDs)), a fabric and garment-integrated type (e.g., an electronic apparel), a body-attached type (e.g., a skin pad or tattoos), and a bio-implantable type (e.g., an implantable circuit). The electronic device may include televisions (TVs), digital versatile disc (DVD) players, audio devices, refrigerators, air conditioners, cleaners, ovens, microwave ovens, washing machines, air cleaners, set-top boxes, home automation control panels, security control panels, media boxes (e.g., Samsung HomeSync™, Apple TV™, and Google TV™), game consoles (e.g., Xbox™ or PlayStation™), electronic dictionaries, electronic keys, camcorders, electronic picture frames, and the like.

An electronic device may include various medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, Global Navigation Satellite System (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, drones, automatic teller machines (ATMs), points of sales (POSs) devices, or Internet of Things (IoT) devices (e.g., light bulbs, various sensors, sprinkler devices, fire alarms, thermostats, street lamps, toasters, exercise equipment, hot water tanks, heaters, boilers, and the like). The electronic device may include parts of furniture, parts of buildings/structures, electronic boards, electronic signature receiving devices, projectors, and various measuring instruments (e.g., water meters, electricity meters, gas meters, wave meters, and the like). The electronic device may be a flexible electronic device or a combination of the above described devices. Furthermore, an electronic device according to an embodiment of the present disclosure may not be limited to the above-described electronic devices. In this disclosure, the term "user" may refer to a person who uses an electronic device or may refer to a device (e.g., an artificial intelligence electronic device) that uses the electronic device.

Referring to FIG. 1, an electronic device 101 in a network environment is described. The electronic device 101 may include a bus 110, a processor 120, a memory 130, an input/output interface 150, a display 160, and a communication interface 170. The electronic device 101 may not include at least one of the above described elements and may further include other element(s). The bus 110 may interconnect the above described elements 110 to 170 and may include a circuit for conveying communications (e.g., a control message and/or data) among the above described elements. The processor 120 may include one or more of a CPU, AP, and a communication processor (CP). The processor 120 may perform an arithmetic operation or data processing associated with control and/or communication of other elements of the electronic device 101.

The memory 130 may include a volatile and/or nonvolatile memory. The memory 130 may store instructions and data associated with other element(s) of the electronic device 101. The memory 130 may store software and/or a program 140. The program 140 may include a kernel 141, a middleware 143, an application programming interface (API) 145, and/or an application program (or "an application") 147. Part of the kernel 141, the middleware 143, and the API 145 may be referred to as an "operating system (OS)". The kernel 141 may control and manage system resources (e.g., the bus 110, the processor 120, the memory 130, and the like) that are used to execute operations and functions of other programs (e.g., the middleware 143, the API 145, and the application program 147). Furthermore, the kernel 141 may provide an interface that allows the middleware 143, the API 145, and the application program 147 to access discrete elements of the electronic device 101 so as to control and manage system resources.

The middleware 143 may perform a mediation role such that the API 145 or the application program 147 communicates with the kernel 141 to exchange data. Furthermore, the middleware 143 may process one or more task requests received from the application program 147 according to a priority. The middleware 143 may assign the priority, which makes it possible to use a system resource (e.g., the bus 110, the processor 120, the memory 130, and the like) of the electronic device 101, to the application program 147 and may process the task requests. The API 145 may be an interface through which the application program 147 controls a function provided by the kernel 141 and the middleware 143, and may include an interface and function (e.g., an instruction) for a file control, a window control, image processing, a character control, and the like. The input/output interface 150 may transmit an instruction or data input from a user or another external device, to other element(s) of the electronic device 101 or may output an instruction or data, received from other element(s) of the electronic device 101, to a user or another external device.

The display 160 may include a liquid crystal display (LCD), a light-emitting diode (LED) display, an organic LED (OLED) display, a microelectromechanical systems (MEMS) display, an electronic paper display, and the like. The display 160 may display various contents (e.g., a text, an image, a video, an icon, a symbol, and the like) to a user. The display 160 may include a touch screen and may receive a touch, gesture, proximity, and hovering input using an electronic pen or a part of a user's body. The communication interface 170 may establish communication between the electronic device 101 and an external device (e.g., the first electronic device 102, the second electronic device 104, and the server 106). The communication interface 170 may be connected to the network 162 over wireless communication and wired communication to communicate with the external device (e.g., the second electronic device 104 and the server 106).

The wireless communication may include cellular communication using long-term evolution (LTE), LTE advanced (LTE-A), code division multiple access (CDMA), wideband CDMA (WCDMA), universal mobile telecommunications system (UMTS), wireless broadband (WiBro), global system for mobile communications (GSM), and the like. The wireless communication may include wireless fidelity (Wi-Fi), Bluetoot®, Bluetooth low energy (BLE), Zigbee, near field communication (NFC), magnetic stripe transmission (MST), radio frequency (RF), a body area network, and the like. According to an embodiment, the wireless communication may include GNSS. The GNSS may be a global positioning system (GPS), a global navigation satellite system (Glonass), a Beidou navigation satellite system (Beidou), and a European global satellite-based navigation system (Galileo). Hereinafter, in this present disclosure, "GPS" and "GNSS" may be interchangeably used. The wired communication may include a universal serial bus (USB), a high definition multimedia interface (HDMI), a recommended standard-232 (RS-232), powerline communication, a plain old telephone service (POTS), and the like. The network 162 may include telecommunications networks (e.g., a computer network (e.g., LAN or WAN)), the Internet, and a telephone network.

Each of the first and second electronic devices 102 and 104 may be a device of which the type is different from or the same as that of the electronic device 101. All or a portion of operations that the electronic device 101 will perform may be executed by another or a plurality of electronic devices (e.g., the first electronic device 102, the second electronic device 104 or the server 106). According to an embodiment of the present disclosure, in the case where the electronic device 101 executes any function or service automatically or in response to a request, the electronic device 101 may not perform the function or the service internally, but it may request at least a portion of a function associated with the electronic device 101 from another electronic device (e.g., the electronic device 102, the electronic device 104, and the server 106). The other electronic device may execute the requested function or additional functions and may transmit the execution result to the electronic device 101. The electronic device 101 may provide the requested function or service using the received result or may additionally process the received result to provide the requested function or service. To this end, cloud computing, distributed computing, and client-server computing may be used.

Figure 2:
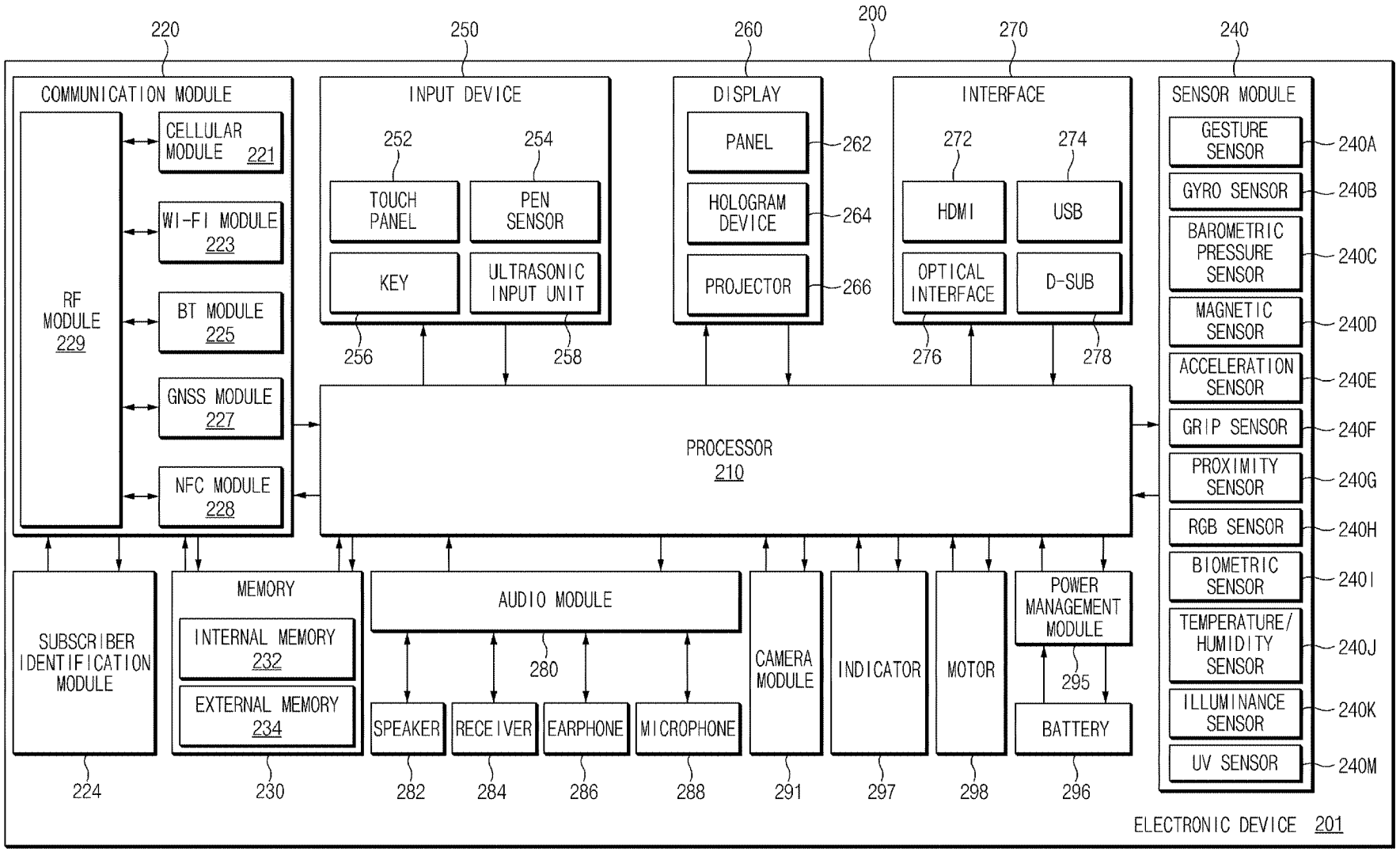
FIG. 2 illustrates a block diagram of the electronic device according to various embodiments of the present disclosure.

FIG. 2 illustrates a block diagram of an electronic device, according to an embodiment of the present disclosure. An electronic device 201 may include all or a part of the electronic device 101 illustrated in FIG. 1. The electronic device 201 may include one or more processors (e.g., an AP) 210, a communication module 220, a subscriber identification module (SIM) 224, a memory 230, a sensor module 240, an input device 250, a display 260, an interface 270, an audio module 280, a camera module 291, a power management module 295, a battery 296, an indicator 297, and a motor 298. The processor 210 may be implemented with a System on Chip (SoC). The processor 210 may further include a graphic processing unit (GPU) and/or an image signal processor. The processor 210 may include a part (e.g., a cellular module 221) of elements illustrated in FIG. 2. The processor 210 may load an instruction or data, which is received from other elements (e.g., a nonvolatile memory), into a volatile memory and process the loaded instruction or data. The processor 210 may store result data in the nonvolatile memory.

The communication module 220 may be configured the same as or similar to the communication interface 170 of FIG. 1. The communication module 220 may include the cellular module 221, a Wi-Fi module 223, a Bluetooth (BT) module 225, a GNSS module 227, an NFC module 228, and an RF module 229. The cellular module 221 may provide voice communication, video communication, a character service, an Internet service, and the like over a communication network. The cellular module 221 may perform discrimination and authentication of the electronic device 201 within a communication network by using the SIM 224 (e.g., a SIM card). The cellular module 221 may perform a portion of functions that the processor 210 provides. The cellular module 221 may include a CP. A part (e.g., two or more) of the cellular module 221, the Wi-Fi module 223, the BT module 225, the GNSS module 227, and the NFC module 228 may be included within one Integrated Circuit (IC) or an IC package. The RF module 229 may transmit and receive a communication signal (e.g., an RF signal). The RF module 229 may include a transceiver, a power amplifier module (PAM), a frequency filter, a low noise amplifier (LNA), an antenna, and the like. The cellular module 221, the Wi-Fi module 223, the BT module 225, the GNSS module 227, and the NFC module 228 may transmit and receive an RF signal through a separate RF module. The SIM 224 may include a card and/or embedded SIM that includes a subscriber identification module and may include unique identify information (e.g., integrated circuit card identifier (ICCID)) or subscriber information (e.g., international mobile subscriber identity (IMSI)).

The memory 230 may include an internal memory 232 or an external memory 234. The internal memory 232 may include a volatile memory (e.g., a dynamic random access memory (DRAM), a static RAM (SRAM), a synchronous DRAM (SDRAM), or the like), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory, a hard drive, and a solid state drive (SSD). The external memory 234 may include a flash drive such as compact flash (CF), secure digital (SD), micro secure digital (Micro-SD), mini secure digital (Mini-SD), extreme digital (xD), a multimedia card (MMC), a memory stick, and the like. The external memory 234 may be operatively and/or physically connected to the electronic device 201 through various interfaces.

The sensor module 240 may measure a physical quantity and may detect an operation state of the electronic device 201. The sensor module 240 may convert the measured and detected information to an electric signal. The sensor module 240 may include a gesture sensor 240A, a gyro sensor 240B, a barometric pressure sensor 240C, a magnetic sensor 240D, an acceleration sensor 240E, a grip sensor 240F, the proximity sensor 240G, a color sensor 240H (e.g., red, green, blue (RGB) sensor), a biometric sensor 240I, a temperature/humidity sensor 240J, an illuminance sensor 240K, and an UV sensor 240M. Although not illustrated, the sensor module 240 may further include an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 240 may further include a control circuit for controlling one or more sensors included therein. According to an embodiment, the electronic device 201 may further include a processor that is a part of the processor 210 or independent of the processor 210 and is configured to control the sensor module 240. The processor may control the sensor module 240 while the processor 210 remains at a sleep state.

The input device 250 may include a touch panel 252, a (digital) pen sensor 254, a key 256, and an ultrasonic input unit 258. The touch panel 252 may use capacitive, resistive, infrared, and ultrasonic detecting methods. Also, the touch panel 252 may further include a control circuit. The touch panel 252 may further include a tactile layer to provide a tactile reaction to a user. The (digital) pen sensor 254 may be a part of a touch panel or may include an additional sheet for recognition. The key 256 may include a physical button, an optical key, and a keypad. The ultrasonic input device 258 may detect (or sense) an ultrasonic signal, which is generated from an input device, through a microphone 288 and may check data corresponding to the detected ultrasonic signal.

The display 260 (e.g., the display 160) may include a panel 262, a hologram device 264, a projector 266, and/or a control circuit for controlling the panel 262, the hologram device 264, or the projector 266. The panel 262 may be implemented to be flexible, transparent and wearable. The panel 262 and the touch panel 252 may be integrated into a single module. The panel 262 may include a pressure sensor (or force sensor) that measures the intensity of touch pressure by a user. The pressure sensor may be integrated with the touch panel 252, or may be implemented as a sensor separately from the touch panel 252. The hologram device 264 may display a stereoscopic image in a space using a light interference phenomenon. The projector 266 may project light onto a screen to display an image. The screen may be arranged in the inside or the outside of the electronic device 201. The interface 270 may include an HDMI 272, a USB 274, an optical interface 276, and a D-subminiature (D-sub) 278. The interface 270 may be included in the communication interface 170 illustrated in FIG. 1. The interface 270 may include a mobile high definition link (MHL) interface, a SD card/multi-media card (MMC) interface, and an infrared data association (IrDA) standard interface.

The audio module 280 may convert a sound and an electric signal in dual directions. Part of the audio module 280 may be included in the input/output interface 150 illustrated in FIG. 1. The audio module 280 may process sound information that is input or output through a speaker 282, a receiver 284, an earphone 286, and the microphone 288. The camera module 291 may shoot a still image or video. The camera module 291 may include one or more image sensors (e.g., a front sensor or a rear sensor), a lens, an image signal processor (ISP), and a flash (e.g., an LED or a xenon lamp). The power management module 295 may manage power of the electronic device 201. According to an embodiment, a power management integrated circuit (PMIC), a charger IC, and a battery gauge may be included in the power management module 295. The PMIC may have a wired charging method and/or a wireless charging method. The wireless charging method may include, a magnetic resonance method, a magnetic induction method and an electromagnetic method and may further include an additional circuit, for example, a coil loop, a resonant circuit, a rectifier, and the like. The battery gauge may measure a remaining capacity of the battery 296 and a voltage, a current, and temperature thereof while the battery is charged. The battery 296 may include a rechargeable battery and/or a solar battery.

The indicator 297 may display a specific state of the electronic device 201 or a part thereof (e.g., the processor 210), such as a booting state, a message state, a charging state, and the like. The motor 298 may convert an electrical signal into a mechanical vibration and may generate a vibration effect, a haptic effect, and the like. The electronic device 201 may include a processing device (e.g., a GPU) for supporting a mobile TV. The processing device while supporting the mobile TV may process media data according to the standards of digital multimedia broadcasting (DMB), digital video broadcasting (DVB), MediaFLO™, and the like. Each of the above-mentioned elements of the electronic device according to various embodiments of the present disclosure may be configured with one or more components, and the names of the elements may be changed according to the type of the electronic device. Some elements of the electronic device 201 may be omitted or other additional elements may be added. Furthermore, some of the elements of the electronic device may be combined with each other to form one entity, so that the functions of the elements may be performed in the same manner as before the combination.

Figure 3:
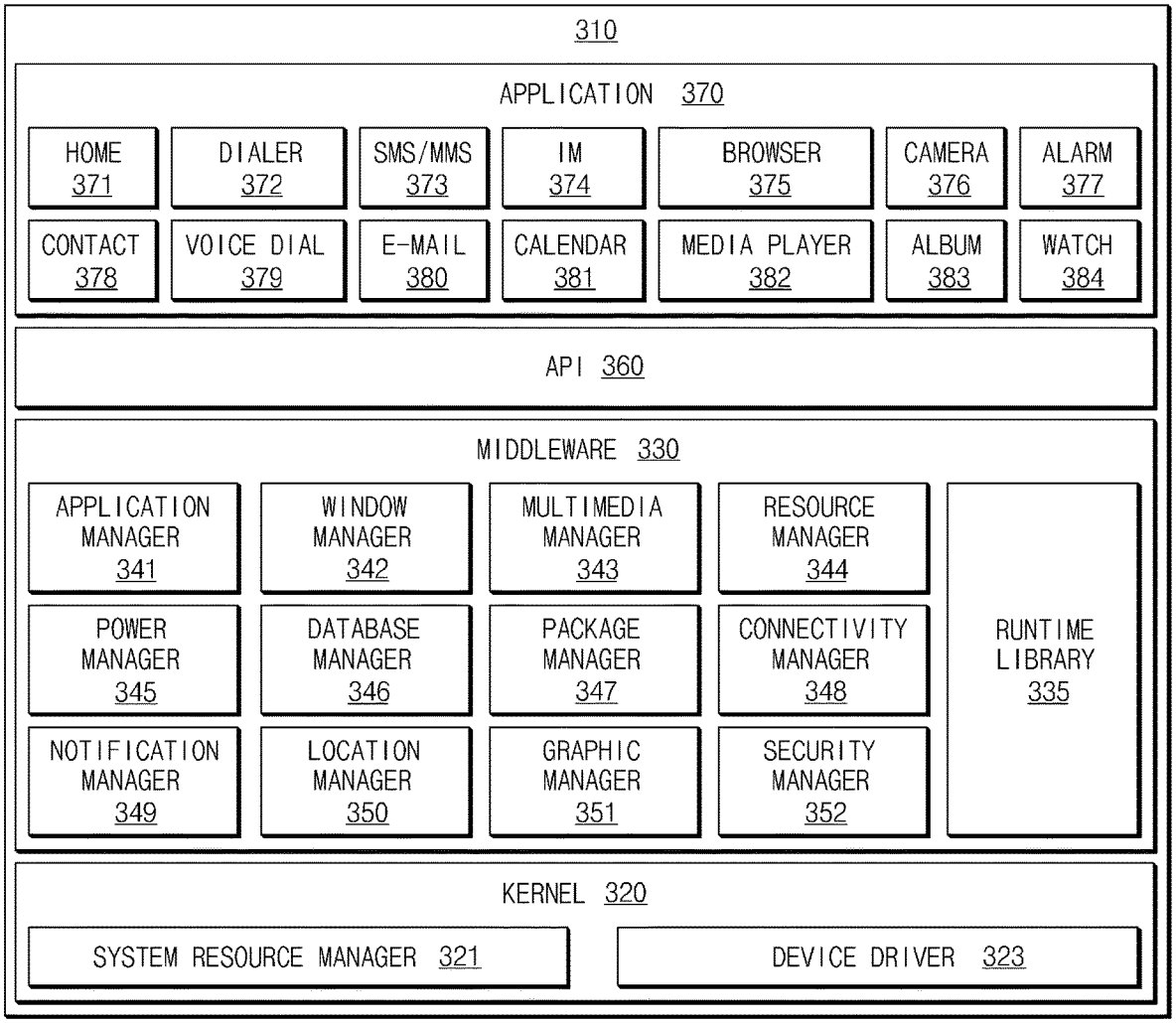
FIG. 3 illustrates a block diagram of a program module according to various embodiments of the present disclosure.

FIG. 3 illustrates a block diagram of a program module, according to an embodiment of the present disclosure. According to an embodiment, a program module 310 (e.g., the program 140) may include an operating system (OS) to control resources associated with an electronic device, and/or diverse applications 147 driven on the OS. The OS may be, for example, Android™, iOS™, Windows™, Symbian™, Tizen™, or Bada™. The program module 310 may include a kernel 320, a middleware 330, an application programming interface (API) 360, and/or an application 370. At least a portion of the program module 310 may be preloaded on an electronic device or may be downloadable from an external electronic device (e.g., first electronic device 102, second electronic device 104, the server 106, and the like).

The kernel 320 may include a system resource manager 321 and a device driver 323. The system resource manager 321 may control, allocate, or retrieve system resources. The system resource manager 321 may include a process managing unit, a memory managing unit, a file system managing unit, and the like. The device driver 323 may include a display driver, a camera driver, a Bluetooth driver, a shared memory driver, a USB driver, a keypad driver, a Wi-Fi driver, an audio driver, and an inter-process communication (IPC) driver. The middleware 330 may provide a function that the application 370 needs in common, and may provide diverse functions to the application 370 through the API 360 to allow the application 370 to efficiently use limited system resources of the electronic device. The middleware 330 may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, and a security manager 352.

The runtime library 335 may include, for example, a library module that is used by a compiler to add a new function through a programming language while the application 370 is being executed. The runtime library 335 may perform input/output management, memory management, and capacities about arithmetic functions. The application manager 341 may manage a life cycle of at least one application of the application 370. The window manager 342 may manage a graphic user interface (GUI) resource that is used in a screen. The multimedia manager 343 may identify a format necessary for playing diverse media files, and may perform encoding or decoding of media files by using a codec suitable for the format. The resource manager 344 may manage resources such as a memory space or source code of the application 370. The power manager 345 may manage a battery or power, and may provide power information for an operation of an electronic device. The power manager 345 may operate with a basic input/output system (BIOS). The database manager 346 may generate, search for, and modify database that is to be used in the application 370. The package manager 347 may install or update an application that is distributed in the form of a package file.

The connectivity manager 348 may manage a wireless connection. The notification manager 349 may provide an event arrival message, appointment, and proximity notification to a user. The location manager 350 may manage location information about an electronic device. The graphic manager 351 may manage a graphic effect that is provided to a user, and manage a user interface relevant thereto. The security manager 352 may provide system security and user authentication. The middleware 330 may include a telephony manager for managing a voice and video call function of the electronic device and a middleware module that combines diverse functions of the above described elements. The middleware 330 may provide a module specialized to each OS to provide differentiated functions. Additionally, the middleware 330 may dynamically remove a part of the preexisting elements and may add new elements thereto. The API 360 may be a set of programming functions and may be provided with a configuration that is dependent on an OS. In the case where an OS is Android or iOS, it may provide one API set per platform. In the case where an OS is Tizen, it may provide two or more API sets per platform.

The application 370 may include applications such as a home 371, a dialer 372, an SMS/MMS 373, an instant message (IM) 374, a browser 375, a camera 376, an alarm 377, a contact 378, a voice dial 379, an e-mail 380, a calendar 381, a media player 382, an album 383, a watch 384, health care (e.g., measuring an exercise quantity, blood sugar level, and the like) and offering of environment information (e.g., information of barometric pressure, humidity, temperature, and the like). The application 370 may include an information exchanging application to support information exchange between an electronic device and an external electronic device. The information exchanging application may include a notification relay application for transmitting specific information to an external electronic device, and a device management application for managing the external electronic device. The notification relay application may include a function of transmitting notification information, which arise from other applications, to an external electronic device and may receive notification information from an external electronic device and provide the notification information to a user. The device management application may install, delete, and update, a function (e.g., turn-on/turn-off of an external electronic device itself (or a part of components) or adjustment of brightness (or resolution) of a display) of the external electronic device which communicates with the electronic device, and an application running in the external electronic device. The application 370 may include an application (e.g., a health care application of a mobile medical device) that is assigned in accordance with an attribute of an external electronic device. According to an embodiment, the application 370 may include an application that is received from an external electronic device. A portion of the program module 310 may be implemented by software, firmware, hardware (e.g., the processor 210), or a combination (e.g., execution) of two or more thereof, and may include modules, programs, routines, sets of instructions, processes, or the like for performing one or more functions.

Figure 4:
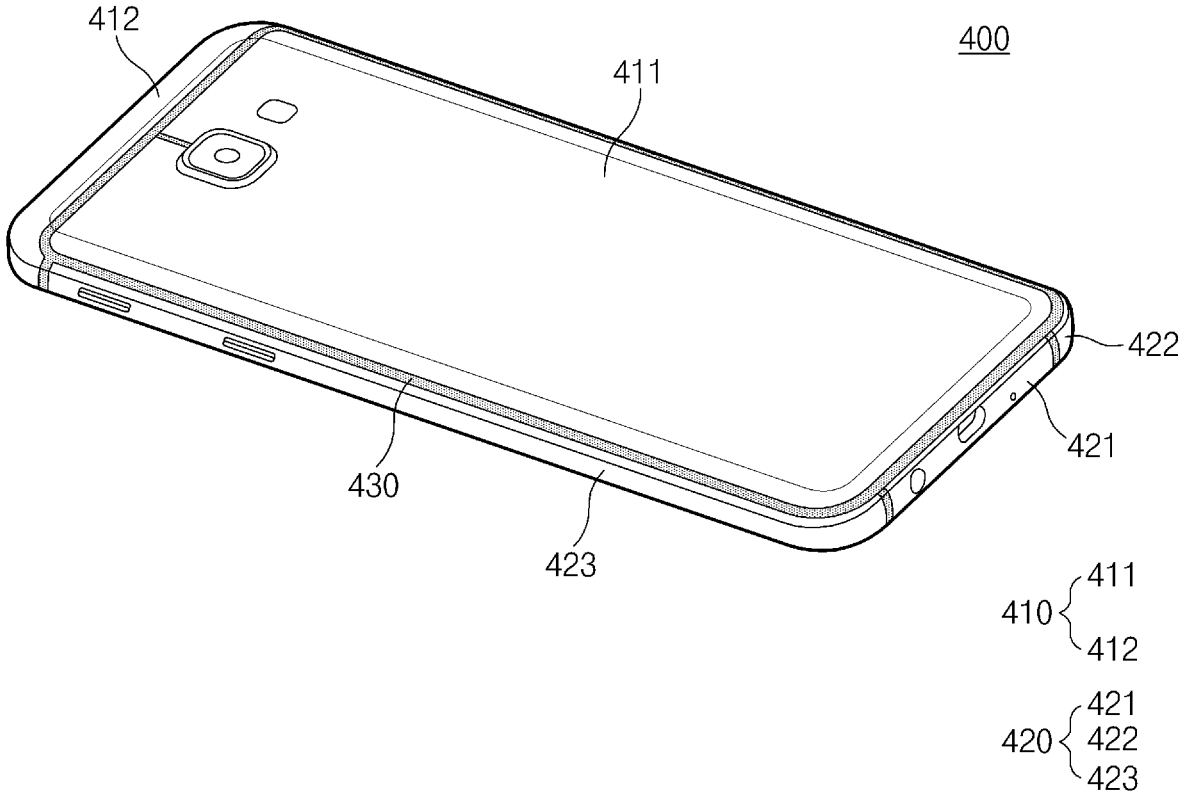
FIG. 4 is a perspective view of the electronic device according to an embodiment of the present disclosure.

FIG. 4 is a perspective view of an electronic device according to an embodiment of the present disclosure.

Referring to FIG. 4, an electronic device 400 according to an embodiment may include a metal housing 410, a conductive member 420, and a nonconductive member 430.

The metal housing 410 may be disposed to cover at least part of a rear surface of the electronic device 400. A central part 411 of the metal housing 410 may cover, for example, most elements of the electronic device 400 such as a printed circuit board, a battery, and the like. A hole through which a camera module is exposed may be defined in the central part 411 of the metal housing 410. At least one point of the central part 411 of the metal housing 410 may be physically connected with an upper end part 412 of the metal housing 410. One point of the central part 411 of the metal housing 410 may be connected with one point of the upper end part 412 of the metal housing 410 through a connection part under the nonconductive member 430.

The metal housing 410 may include a slot. For example, one or more slots may be formed between the upper end part 412 and the central part 411 of the metal housing 410. The one or more slots formed in the metal housing 410 may be filled with the nonconductive member 430.

The conductive member 420 may be disposed to cover at least part of a side surface of the electronic device 400. The conductive member 420 may include a metal frame surrounding at least part of the side surface of the electronic device 400. The conductive member 420 may be separated by the nonconductive member 430. One or more holes through which a USB connector, an ear jack, and/or a microphone is exposed may be formed in a lower end part 421 of the conductive member 420. The lower end part 421 of the conductive member 420 may be adjacent to a first side part 422 and a second side part 423 of the conductive member 420. Since a distance between the conductive member 420 and the metal housing 410 is sufficiently close to each other, the conductive member 420 may be electrically coupled with the metal housing 410. If the conductive member 420 is electrically coupled with the metal housing 410, there is reduced radiation performance of an antenna that uses the conductive member 420 as an antenna resonant element. To prevent the reduction of the radiation performance, the conductive member 420 may be electrically connected with a ground plate through a plurality of ground parts.

The nonconductive member 430 may be interposed between the metal housing 410 and the conductive member 420. The nonconductive member 430 may be brought into contact with the metal housing 410 and the conductive member 420. The nonconductive member 430 may be formed in a track shape. The slot(s) of the metal housing 410 and the separation(s) of the conductive member 420 may be filled by the nonconductive member 430. The metal housing 410 may be spaced apart from the conductive member 420 by the nonconductive member 430.

Figure 5:
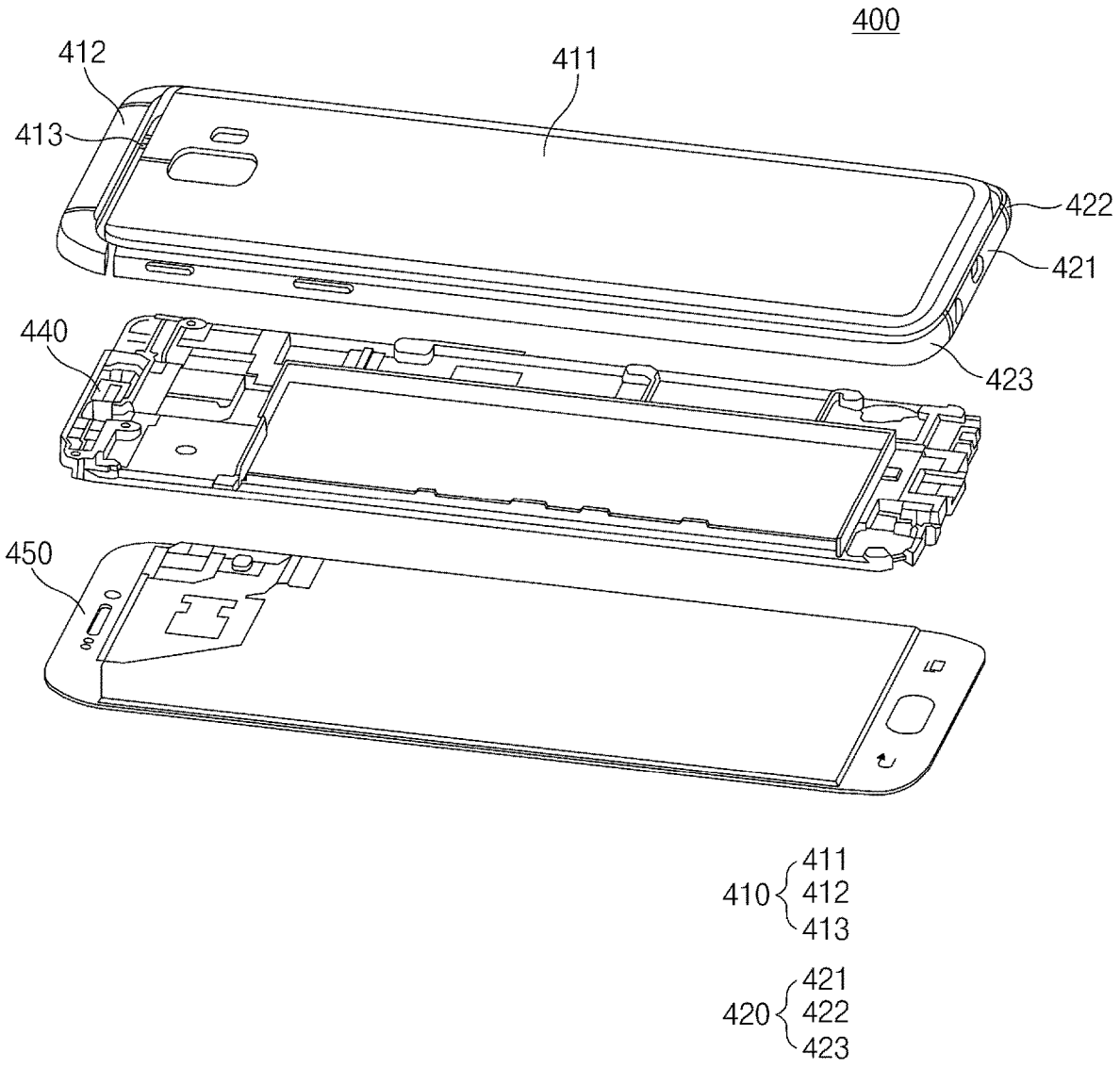
FIG. 5 is an exploded perspective view of the electronic device according to an embodiment of the present disclosure.

FIG. 5 is an exploded perspective view of an electronic device according to an embodiment of the present disclosure.

Referring to FIG. 5, the electronic device 400 according to an embodiment may include the metal housing 410, the conductive member 420, a bracket 440, and a display module 450. For convenience of description, a description that is given with reference to FIG. 4 will not be repeated here.

The metal housing 410 may include a connection part 413 that connects the central part 411 and the upper end part 412 of the metal housing 410. The central part 411 of the metal housing 410 may be physically connected with the upper end part 412 of the metal housing 410 through the connection part 413. One or more slots may be formed on a left side and/or a right side of the connection part 413 of the metal housing 410.

The bracket 440 may be disposed under the metal housing 410. The bracket 440 may be connected with elements of the electronic device 400 such as the display module 450, a printed circuit board, a flexible printed circuit board, a camera module, and/or a receiver and may support the elements. Part of the bracket 440 may be formed of metal. The bracket 440 may be formed of magnesium alloy. The bracket 440 may be disposed within a space defined by the metal housing 410 and the conductive member 420.

The display module 450 may be disposed under the bracket 440. The display module 450 may include a display panel, a display driver integrated circuit, and/or a cover glass. The display module 450 may be disposed within a space defined by the metal housing 410 and the conductive member 420.

Figure 6:
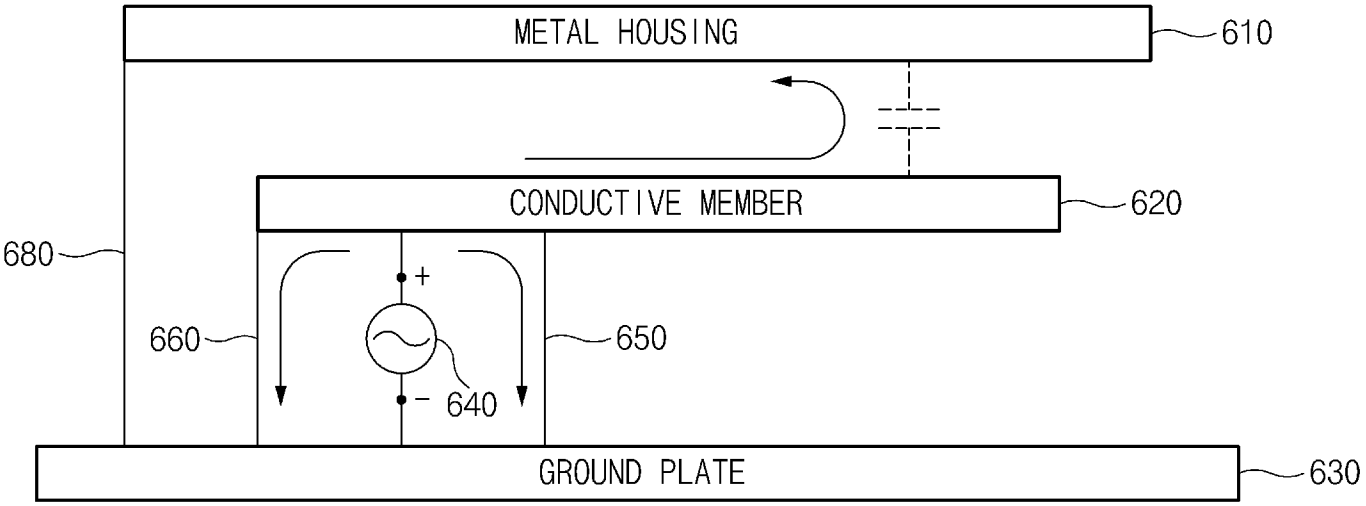
FIG. 6 illustrates a configuration of an antenna included in the electronic device according to an embodiment of the present disclosure.

FIG. 6 illustrates a configuration of an antenna included in an electronic device according to an embodiment of the present disclosure.

Referring to FIG. 6, an electronic device according to an embodiment may include a metal housing 610, a conductive member 620, a ground plate 630, a feeding part 640, a first ground part 650, a second ground part 660, and a ground path 680.

The metal housing 610 may be disposed to cover at least part of a rear surface of the electronic device. The metal housing 610 may cover elements of the electronic device such as the ground plate 630, the feeding part 640, the first ground part 650, the second ground part 660, and the ground path 680. The metal housing 610 may be connected with the ground plate 630 through the ground path 680 so that metal housing 610 may be grounded.

The conductive member 620 may be disposed to cover at least part of a side surface of the electronic device. The conductive member 620 may include a metal frame surrounding at least part of the side surface of the electronic device. The conductive member 620 may be a metal frame that is disposed at a lower end of the electronic device. The conductive member 620 may be adjacent to the metal housing 610. Although not illustrated in FIG. 6, a nonconductive member (e.g., the nonconductive member 430 of FIG. 4) may be interposed between the conductive member 620 and the metal housing 610. The conductive member 620 may be electrically coupled with the metal housing 610.

The conductive member 620 may be used as an antenna resonant element. The conductive member 620 may radiate an electrical signal transferred to the conductive member 620 to the outside and may receive an electrical signal from the outside. If the conductive member 620 is electrically coupled with the metal housing 610, part of a current flowing to the conductive member 620 may be leaked to the metal housing 610.

The ground plate 630 may be electrically connected with the metal housing 610 and the conductive member 620. The ground plate 630 may be connected with the metal housing 610 through the ground path 680 and may be connected with the conductive member 620 through the first ground part 650 and the second ground part 660. The ground plate 630 may be disposed within a space defined by the metal housing 610 and the conductive member 620.

The feeding part 640 may be electrically connected with the conductive member 620 and the ground plate 630. The feeding part 640 may be connected with part of the conductive member 620 and may feed the conductive member 620. The feeding part 640 may transmit and receive a radio frequency (RF) signal through the conductive member 620.

The first ground part 650 may be electrically connected with a point (hereinafter referred to as a "first point") of the conductive member 620. The first ground part 650 may electrically connect the conductive member 620 and the ground plate 630. Part of an electrical signal fed from the feeding part 640 may be transferred from the conductive member 620 to the ground plate 630 through the first ground part 650.

The second ground part 660 may be electrically connected with a point (hereinafter referred to as a "second point") of the conductive member 620. The second ground part 660 may electrically connect the conductive member 620 and the ground plate 630. Part of an electrical signal fed from the feeding part 640 may be transferred from the conductive member 620 to the ground plate 630 through the second ground part 660.

In FIG. 6, an embodiment of the present disclosure is shown as the conductive member 620 is connected with the ground plate 630 through the two ground parts 650 and 660. However, embodiments of the present disclosure may not be limited thereto. The conductive member 620 may be electrically connected with the ground plate 630 through three or more ground parts.

The feeding part 640 may be electrically connected with one point of the conductive member 620. The feeding part 640 may be electrically connected with the first point or the second point. Part of an electrical signal fed from the feeding part 640 may be transferred from the conductive member 620 to the first ground part 650 and the second ground part 660 through the first point and the second point. The at least part of the electrical signal fed from the feeding part 640 may be leaked to the metal housing 610 from the conductive member 620.

An antenna included in the electronic device may operate as follows. An electrical signal fed by the feeding part 640 may be transferred to the conductive member 620. Part of the electrical signal fed to the conductive member 620 may be leaked to the metal housing 610 that is electrically coupled with the conductive member 620. The radiation efficiency of the antenna may decrease due to the metal housing 610 that is applied to the rear surface of the electronic device.

It may be possible to reduce leakage of an electrical signal to the metal housing 610 by connecting the conductive member 620 with the ground plate 630 through a plurality of ground parts. At least part of an electrical signal transferred to the conductive member 620 may be transferred to the first ground part 650 and the second ground part 660. The conductive member 620, the first ground part 650, and the second ground part 660 may operate as an antenna resonant element. The electrical signal transferred to the first ground part 650 and the second ground part 660 may be radiated to the outside. If the conductive member 620 is connected with the ground plate 630 through a plurality of ground parts including the first ground part 650 and the second ground part 660, compared with the case where the conductive member 620 is connected with the ground plate 630 through one ground part, leakage of an electrical signal to the metal housing 610 may relatively decrease, and an electrical signal transferred to the first ground part 650 or the second ground part 660 that is part of an antenna resonant element may relatively increase. Accordingly, there is an increase in radiation efficiency of the antenna included in the electronic device.

Figure 7:
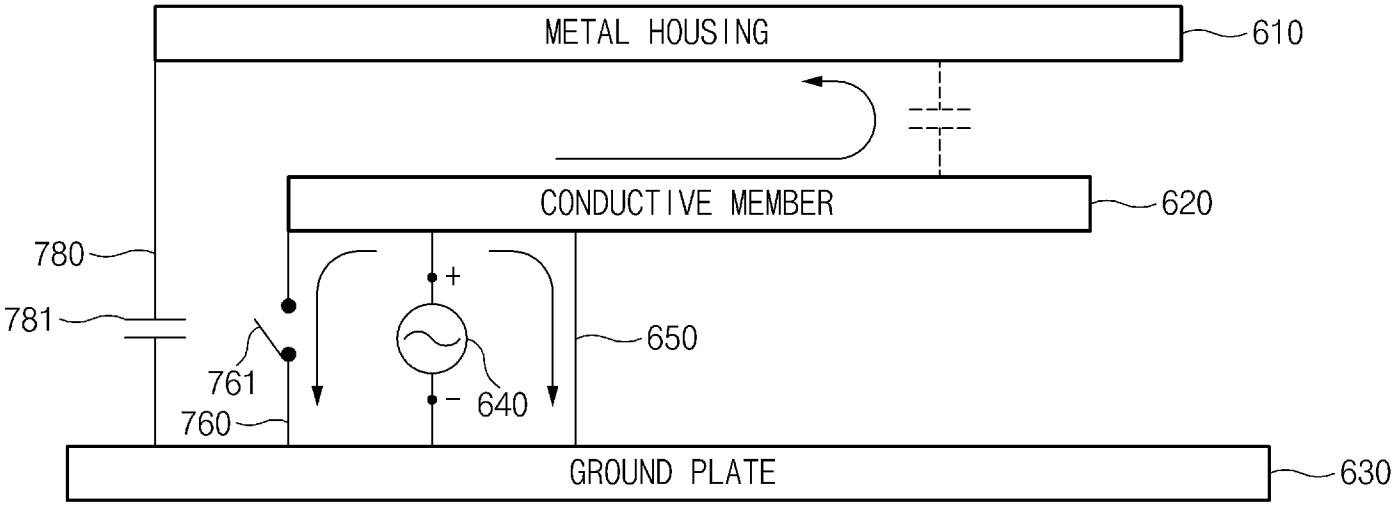
FIG. 7 illustrates a configuration of an antenna included in the electronic device according to an embodiment of the present disclosure.

FIG. 7 illustrates a configuration of an antenna included in an electronic device according to an embodiment of the present disclosure.

Referring to FIG. 7, an electronic device may include the metal housing 610, the conductive member 620, the ground plate 630, the feeding part 640, the first ground part 650, a second ground part 760, a switch 761, a ground path 780, and a capacitor 781. For convenience of description, a description that is given with reference to FIG. 6 will not be repeated here.

The conductive member 620 may be electrically connected with the ground plate 630 through the second ground part 760. The switch 761 may be interposed in the second ground part 760. The switch 761 may be electrically connected with the conductive member 620 and the ground plate 630 through the second ground part 760. The switch 761 may adjust making and breaking of the second ground part 760. The switch 761 may be controlled by a communication processor (e.g., the communication module 220 of FIG. 2) and an application processor (e.g., the processor 210 of FIG. 2).

In the case where the switch 761 is closed (or turned on), the conductive member 620 may be electrically connected with the ground plate 630 through the first ground part 650 and the second ground part 760. An antenna illustrated in FIG. 7 may operate to be similar to an antenna illustrated in FIG. 6. Since the conductive member 620 is connected with the ground plate 630 through a plurality of ground parts including the first ground part 650 and the second ground part 760, the radiation efficiency of the antenna included in the electronic device may increase.

In the case where the switch 761 is opened (or turned off), the conductive member 620 may be electrically connected with the ground plate 630 through the first ground part 650. The conductive member 620 and the first ground part 650 may operate as an antenna resonant element. Since an electrical length of an antenna resonant element is changed and capacitance between the metal housing 610 and the conductive member 620 is changed, a resonant frequency may be adjusted downwards compared with the case where the switch 761 is closed. The resonant frequency of the antenna resonant element may be adjusted by controlling the making and breaking of the switch 761.

Referring to FIG. 7, as the switch 761 is disposed in the second ground part 760. However, embodiments of the present disclosure may not be limited thereto. The switch 761 may be interposed in the first ground part 650.

The metal housing 610 may be electrically connected with the ground plate 630 through the ground path 780. The capacitor 781 may be disposed on the ground path 780. The capacitor 781 may be electrically connected with the metal housing 610 and the ground plate 630 through the ground path 780. A direct current (DC) signal that can flow between the metal housing 610 and the ground plate 630 may be blocked by the capacitor 781, thereby preventing electric shock due to the DC signal.

Figure 8:
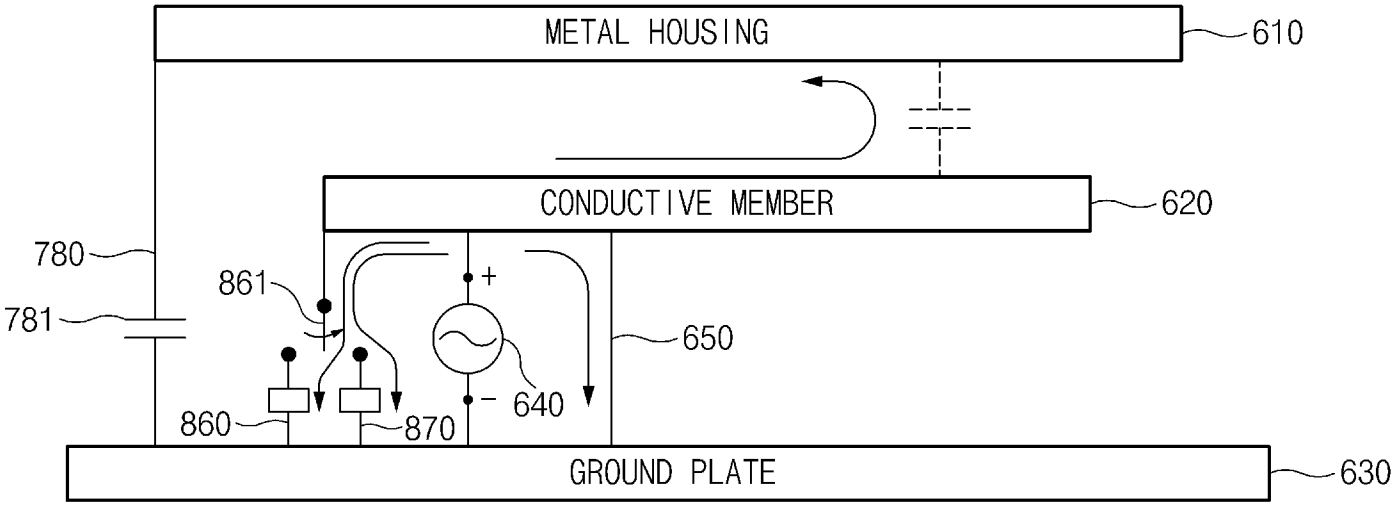
FIG. 8 illustrates a configuration of an antenna included in the electronic device according to an embodiment of the present disclosure.

FIG. 8 illustrates a configuration of an antenna included in an electronic device according to an embodiment of the present disclosure.

Referring to FIG. 8, an electronic device may include the metal housing 610, the conductive member 620, the ground plate 630, the feeding part 640, the first ground part 650, a second ground part 860, a third ground part 870, a switch 861, the ground path 780, and the capacitor 781. For convenience of description, a description that is given with reference to FIG. 6 or 7 will not be repeated here.

The conductive member 620 may be electrically connected with the ground plate 630 through the second ground part 860 or the third ground part 870. The third ground part 870 may be electrically connected with a point (hereinafter referred to as a "third point") of the conductive member 620. As illustrated in FIG. 8, the third point may be the same point as the second point. An electrical length of the third ground part 870 may be different from an electrical length of the second ground part 860. The electrical length of the second ground part 860 may be shorter than the electrical length of the third ground part 870. The second ground part 860 may include a lumped element and may include a capacitive element. Capacitance of the capacitive element included in the second ground part 860 may be about 3.9 pF. The third ground part 870 may include a lumped element and may include an inductive element. Inductance of the inductive element included in the third ground part 870 may be about 2.7 nH. A resonant frequency may change with an element included in the second ground part 860 and/or the third ground part 870.

The switch 861 may be interposed in the second ground part 860 and the third ground part 870. The switch 861 may be electrically connected with the conductive member 620 and the ground plate 630 through the second ground part 860 or the third ground part 870. The switch 861 may adjust making and breaking of the second ground part 860 and the third ground part 870. The switch 861 may be a single pole double throw (SPDT) switch 861. The switch 861 may be controlled by a communication processor or an application processor.

In the case where the switch 861 is connected with the second ground part 860, the conductive member 620 may be electrically connected with the ground plate 630 through the first ground part 650 and the second ground part 860. An antenna illustrated in FIG. 8 may operate to be similar to an antenna illustrated in FIG. 6. Since the conductive member 620 is connected with the ground plate 630 through a plurality of ground parts including the first ground part 650 and the second ground part 860, the radiation efficiency of the antenna included in the electronic device may increase.

In the case where the switch 861 is connected with the third ground part 870, the conductive member 620 may be electrically connected with the ground plate 630 through the first ground part 650 and the third ground part 870. An antenna illustrated in FIG. 8 may operate similarly to an antenna illustrated in FIG. 6. Since the conductive member 620 is connected with the ground plate 630 through a plurality of ground parts including the first ground part 650 and the third ground part 870, the radiation efficiency of the antenna included in the electronic device may increase.

A resonant frequency of an antenna resonant element included in the electronic device may change with an operation of the switch 861. In the case where the switch 861 is connected with the second ground part 860, the first ground part 650 and the second ground part 860 may be used as an antenna ground part connecting the conductive member 620 and the ground plate 630. In the case where the switch 861 is connected with the third ground part 870, the first ground part 650 and the third ground part 870 may be used as an antenna ground part connecting the conductive member 620 and the ground plate 630. Since electrical lengths of the second ground part 860 and the third ground part 870 are different from each other, a ground path and an electrical length of an antenna may be changed depending on a connection state of the switch 861. It may be possible to improve the radiation efficiency of the antenna and to adjust a resonant frequency of the antenna, by controlling the switch 861 electrically connected with the second ground part 860 and the third ground part 870.

Referring to FIG. 8, the second ground part 860 and the third ground part 870 are connected with the one switch 861. However, embodiments of the present disclosure may not be limited thereto. The second ground part 860 and the third ground part 870 may be connected with individual switches, respectively. The electronic device may include a first switch that is disposed on the second ground part 860 to control the making and breaking of the second ground part 860 and a second switch that is disposed on the third ground part 870 to control the making and breaking of the third ground part 870. The first switch and the second switch may be controlled by a communication processor or an application processor.

Figure 9:
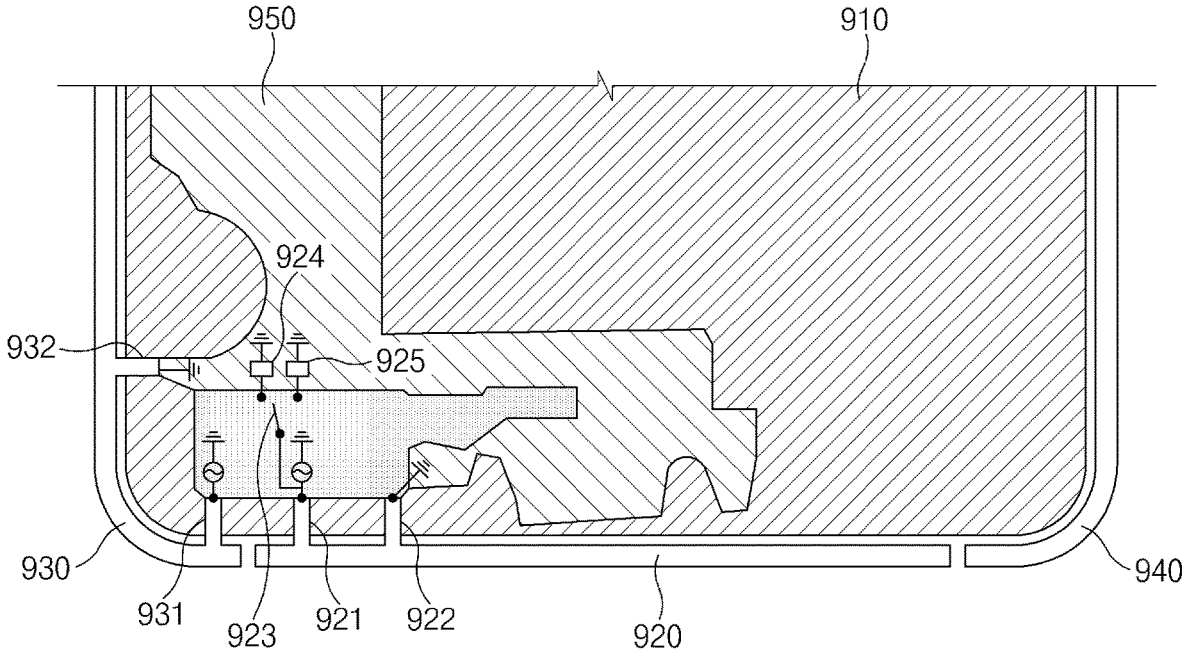
FIG. 9 illustrates an internal configuration of a lower part of the electronic device according to an embodiment of the present disclosure.

FIG. 9 illustrates an internal configuration of a lower part of an electronic device according to an embodiment of the present disclosure.

Referring to FIG. 9, an electronic device may include a metal housing 910, a first metal frame 920, a second metal frame 930, a third metal frame 940, and a printed circuit board 950.

The metal housing 910 may cover a rear surface of the electronic device. The metal housing 910 may be configured to be connected with the first metal frame 920 and the third metal frame 940. The metal housing 910 may cover an element of the electronic device such as the printed circuit board 950.

The first metal frame 920, the second metal frame 930, and the third metal frame 940 may be disposed adjacent to the metal housing 910. The first metal frame 920, the second metal frame 930, and the third metal frame 940 may cover a side surface of the electronic device. The first metal frame 920 may be disposed at a lower end of the electronic device. The second metal frame 930 may be disposed on the left side of the first metal frame 920 so as to be adjacent to the first metal frame 920. The third metal frame 940 may be disposed on the right side of the first metal frame 920 so as to be adjacent to the first metal frame 920.

The first metal frame 920 may be an element corresponding to the conductive member 620 illustrated in FIG. 8. The first metal frame 920 may include a first flange 921 and a second flange 922 that extend toward the interior of the electronic device from the first metal frame 920.

The first flange 921 may be electrically connected with a feeding part 640 connecting an RF transceiver circuit and the first metal frame 920. The first flange 921 may be electrically connected to a ground plate of the printed circuit board 950 through a switch 923. The second flange 922 may be electrically connected with a ground plate 630 through a first ground part 650. An electrical signal fed to the first flange 921 may be transferred to a ground plate through the second flange 922. Also, the electrical signal fed to the first flange 921 may be transferred to the ground plate through a first circuit 924 or a second circuit 925 depending on an operation of the switch 923. The first flange 921, the second flange 922, and/or a third flange 931 may be replaced with a lateral C-clip. C-clips may be disposed at locations where the first flange 921, the second flange 922, and/or a third flange 931 are formed and may electrically connect points of the printed circuit board 950 with the first metal frame 920 and the second metal frame 930.

If the switch 923 is connected with the first circuit 924, the first flange 921 may be electrically connected with the first circuit 924. A resonant frequency of the first metal frame 920 may be about 800 MHz to about 1000 MHz. The first circuit 924 may include a capacitive element. Capacitance of the capacitive element included in the first circuit 924 may be about 3.9 pF.

If the switch 923 is connected with the second circuit 925, the first flange 921 may be electrically connected with the second circuit 925. A resonant frequency of the first metal frame 920 may be about 700 MHz to about 900 MHz. The second circuit 925 may include an inductive element. Inductance of the inductive element included in the second circuit 925 may be about 2.7 nH.

The second metal frame 930 may include the third flange 931 and a fourth flange 932 that extend toward the interior of the electronic device from the second metal frame 930. The third flange 931 may be electrically connected with a feeding part 640. The fourth flange 932 may be electrically connected with a ground plate 630. The second metal frame 930 may operate as an antenna radiator. The second metal frame 930 may be configured to resonate at about 1700 MHz to about 2200 MHz.

The printed circuit board 950 may be disposed within a space that is defined by the metal housing 910, the first metal frame 920, the second metal frame 930, and the third metal frame 940. The printed circuit board 950 may support elements such as a feeding part 640, a ground plate 630, the first circuit 924, the second circuit 925, and the like.

Figure 10:
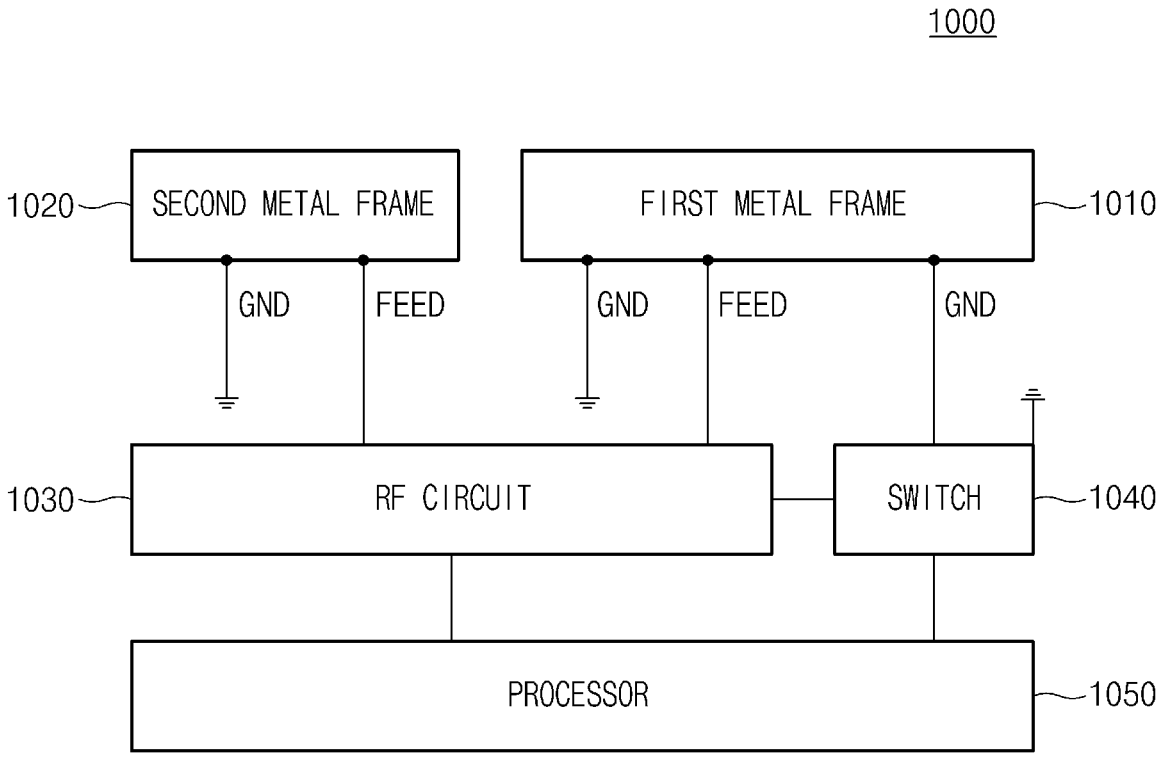
FIG. 10 is a block diagram illustrating a configuration of the electronic device according to an embodiment of the present disclosure.

FIG. 10 is a block diagram illustrating a configuration of an electronic device according to an embodiment of the present disclosure.

Referring to FIG. 10, an electronic device 1000 according to an embodiment may include a first metal frame 1010, a second metal frame 1020, an RF circuit 1030, a switch 1040, and a processor 1050.

The first metal frame 1010, the second metal frame 1020, and the switch 1040 may be the same as the first metal frame 920, the second metal frame 930, and the switch 923 of FIG. 9.

The first metal frame 1010 may be electrically connected with the RF circuit 1030 and the switch 1040. The first metal frame 1010 may be fed through the RF circuit 1030. The first metal frame 1010 may be grounded through connection with a ground plate. The first metal frame 1010 may be connected with the ground plate through the switch 1040, thus being grounded. The first metal frame 1010 may be grounded through the RF circuit 1030. The first metal frame 1010 may be connected to the RF circuit 1030 through the switch 1040 or may be grounded through the switch 1040. A resonant frequency of the first metal frame 1010 may be changed depending on an operation of the switch 1040. The resonant frequency of the first metal frame 1010 may be about 700 MHz to about 1000 MHz. The first metal frame 1010 may resonate at about 2300 MHz to about 2700 MHz.

The second metal frame 1020 may be electrically connected with the RF circuit 1030. The second metal frame 1020 may be fed through the RF circuit 1030. The second metal frame 1020 may be grounded through the RF circuit 1030. A resonant frequency of the second metal frame 1020 may be about 1700 MHz to about 2200 MHz.

The RF circuit 1030 may be electrically connected with the first metal frame 1010, the second metal frame 1020, the switch 1040, and the processor 1050. The RF circuit 1030 may transfer an electrical signal to the first metal frame 1010 and/or the second metal frame 1020. The RF circuit 1030 may receive an electrical signal from the first metal frame 1010 and/or the second metal frame 1020. The RF circuit may include a transmitter (Tx) circuit, a receiver (Rx) circuit, or a transceiver (Tx/Rx) circuit.

The switch 1040 may adjust the making and breaking of a ground part connecting the first metal frame 1010 and the RF circuit 1030. The switch 1040 may be the switch 761 illustrated in FIG. 7, the switch 861 illustrated in FIG. 8, or the switch 923 illustrated in FIG. 9.

The processor 1050 may be a communication processor or an application processor. The processor 1050 may be electrically connected with the RF circuit 1030 and the switch 1040. The processor 1050 may transfer an electrical signal to the RF circuit 1030 and may receive an electrical signal from the RF circuit 1030. The processor 1050 may control the switch 1040.

The processor 1050 may control the switch 1040 based on a frequency band to be used.

The processor 1050 may control the switch 761 illustrated in FIG. 7. To use a relatively high frequency band (e.g., about 800 MHz to about 1000 MHz), the processor 1050 may control the switch 761 such that the switch 761 is turned on. To use a relatively low frequency band (e.g., about 700 MHz to about 900 MHz), the processor 1050 may control the switch 761 such that the switch 761 is turned off.

The processor 1050 may control the switch 861 illustrated in FIG. 8. To use the relatively high frequency band, the processor 1050 may control the switch 861 such that the switch 861 is electrically connected with the second ground part 860. To use the relatively low frequency band, the processor 1050 may control the switch 861 such that the switch 861 is electrically connected with the third ground part 870.

The processor 1050 may control the switch 923 illustrated in FIG. 9. To use the relatively high frequency band, the processor 1050 may control the switch 923 such that the switch 923 is electrically connected with the first circuit 924. To use the relatively low frequency band, the processor 1050 may control the switch 923 such that the switch 923 is electrically connected with the second circuit 925.

Figure 11A:
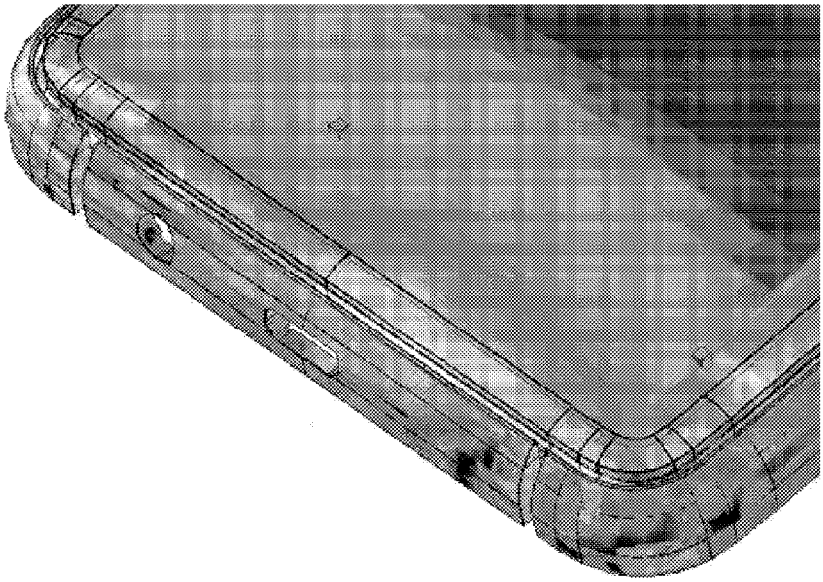
FIGS. 11A and 11B illustrate a current distribution of a lower part of the electronic device according to an embodiment of the present disclosure.
Figure 11B:
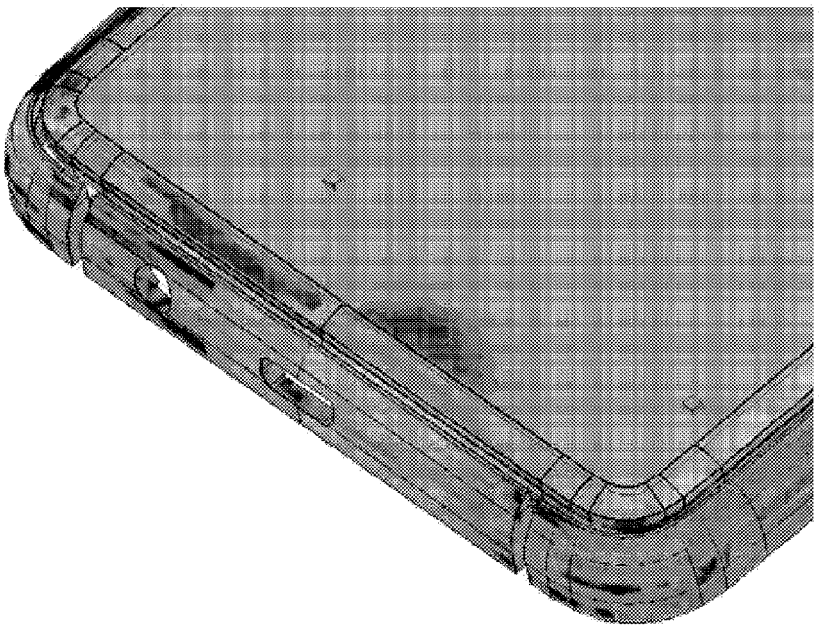

FIGS. 11A and 11B illustrate a current distribution of a lower part of the electronic device according to an embodiment of the present disclosure. FIG. 11A illustrates a current distribution of a surface of an electronic device according to a comparative example in which a lower-end metal frame is connected with a ground plate through one ground part. FIG. 11B illustrates a current distribution of a surface of an electronic device according to an embodiment in which a lower-end metal frame is connected with a ground plate through two ground parts. In FIGS. 11A and 11B, a bright portion corresponds to a portion where current density is high, and a dark portion corresponds to a portion where current density is low.

Referring to FIG. 11A, current density of a lower-end metal frame used as an antenna resonant element of an electronic device according to a comparative example is shown to be relatively high. Since a portion of a rear metal housing, which is adjacent to a lower-end metal frame, is electrically coupled with the lower-end metal frame, current density of the portion of the rear metal housing, which is adjacent to the lower-end metal frame, is also shown to be relatively high. In this case, since the large amount of current is leaked from the lower-end metal frame to the rear metal housing, the radiation efficiency of an antenna of the electronic device may decrease.

Referring to FIG. 11B, current density of a lower-end metal frame used as an antenna resonant element of an electronic device according to an embodiment of the present disclosure is shown to be relatively high. Since the lower-end metal frame of the electronic device is connected with a ground plate through two ground parts, the amount of current leaked from the lower-end metal frame to the rear metal housing may decrease. In this case, as illustrated in FIG. 11B, current density of a portion of the rear metal housing, which is adjacent to the lower-end metal frame, is shown to be relatively low. Since the amount of current leaked from the lower end metal frame to the rear metal housing decreases, the radiation efficiency of an antenna of the electronic device may be improved.

Figure 12:
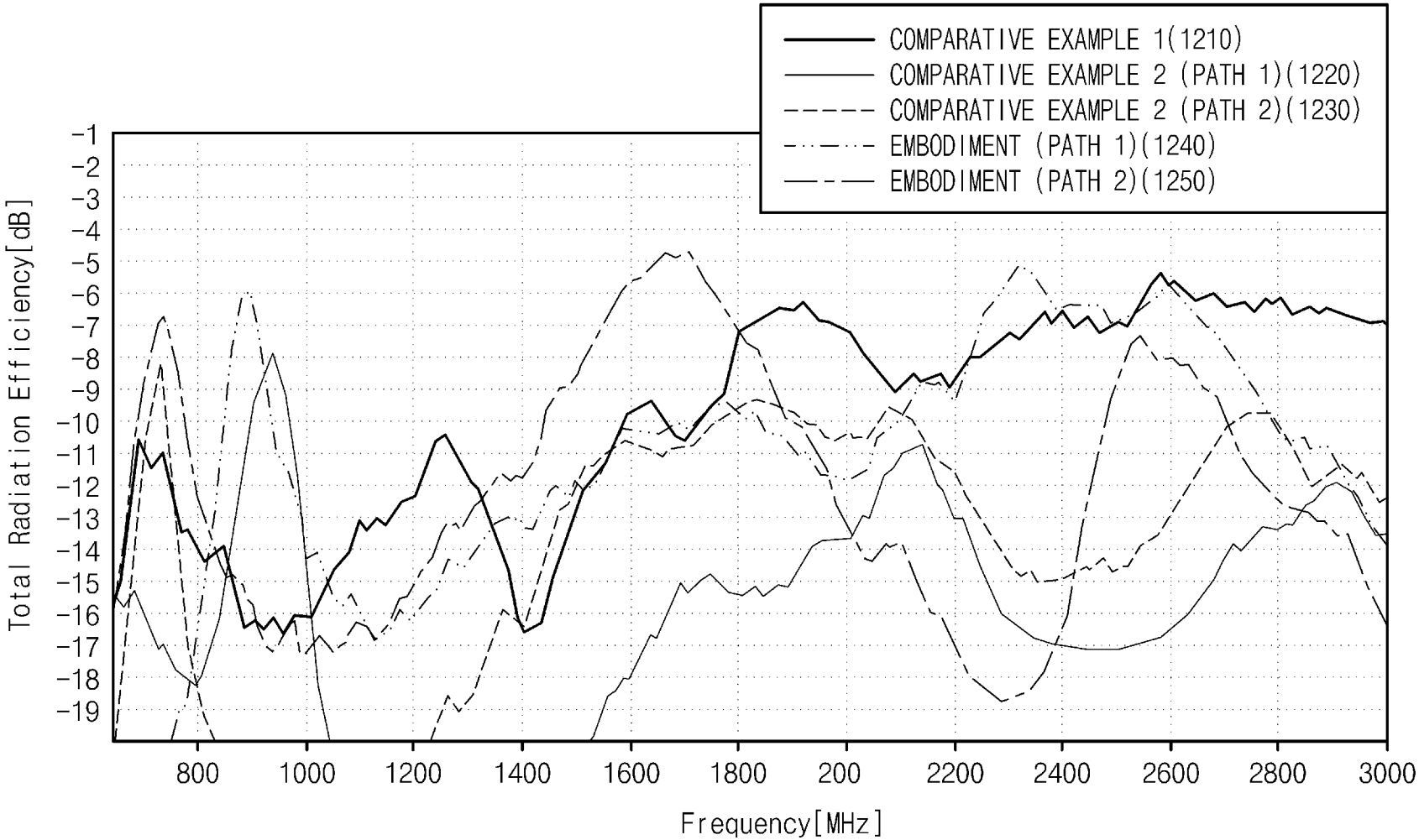
FIG. 12 illustrates total radiation efficiency for each frequency of the antenna included in the electronic device according to an embodiment of the present disclosure.

FIG. 12 illustrates total radiation efficiency for each frequency of an antenna included in an electronic device according to an embodiment of the present disclosure. A metal frame of an electronic device according to a first comparative example is grounded only through the second flange 922 of FIG. 9. A metal frame of an electronic device according to a second comparative example is grounded only through the first flange 921 of FIG. 9. A metal frame of an electronic device is grounded through the first flange 921 and the second flange 922 of FIG. 9.

Referring to FIG. 12, a curve 1210 indicates the total radiation efficiency for each frequency for the antenna of the electronic device according to the first comparative example. The antenna of the electronic device according to the first comparative example may resonate at about 700 MHz. The total radiation efficiency may be about −11.5 dB when the antenna of the electronic device according to the first comparative example resonates at about 700 MHz.

A curve 1220 indicates the total radiation efficiency for each frequency of an antenna of the electronic device according to the second comparative example in the case where the first metal frame 920 of the electronic device according to the second comparative example is connected with the first circuit 924. The antenna of the electronic device according to the second comparative example may resonate at about 900 MHz. The total radiation efficiency may be about −10 dB for the antenna of the electronic device according to the second comparative example which resonates at about 900 MHz.

A curve 1230 indicates the total radiation efficiency for each frequency of the antenna of the electronic device according to the second comparative example in the case where the first metal frame 920 of the electronic device according to the second comparative example is connected with the second circuit 925 The antenna of the electronic device according to the second comparative example may resonate at about 700 MHz. The total radiation efficiency may be about −8.5 dB for the antenna of the electronic device according to the second comparative example which resonates at about 700 MHz.

A curve 1240 indicates the total radiation efficiency for each frequency of an antenna of the electronic device according to an embodiment in the case where the first metal frame 920 of the electronic device according to the embodiment is connected with the first circuit 924 The antenna of the electronic device according to an embodiment may resonate at about 900 MHz. The total radiation efficiency may be about −6 dB when the antenna of the electronic device according to an embodiment resonates at about 900 MHz. At 900 MHz, the total radiation efficiency of the antenna of the electronic device according an embodiment, illustrated by the curve 1240, may be higher by about 4 dB than the total radiation efficiency of the antenna of the electronic device according the second comparative example, illustrated by the curve 1220.

A curve 1250 indicates the total radiation efficiency for each frequency of the antenna of the electronic device according to an embodiment in the case where the first metal frame 920 of the electronic device a is connected with the second circuit 925 The antenna of the electronic device may resonate at about 700 MHz. The total radiation efficiency may be about −7 dB when the antenna of the electronic device resonates at about 700 MHz. At 700 MHz, the total radiation efficiency of the antenna of the electronic device, illustrated by the curve 1250, may be higher by about 4.5 dB than the total radiation efficiency of the antenna of the electronic device according the first comparative example, illustrated by the curve 1210, and may be higher by about 1.5 dB than the total radiation efficiency of the antenna of the electronic device according the second comparative example, illustrated by the curve 1230.

As described above, the radiation efficiency of an antenna of an electronic device where an antenna resonant element is grounded through two ground parts may be improved compared with the case where an antenna resonant element is grounded through one ground part. Also, a resonant frequency of the antenna resonant element may be adjusted by controlling a switch connected with the antenna resonant element.

Figure 13:
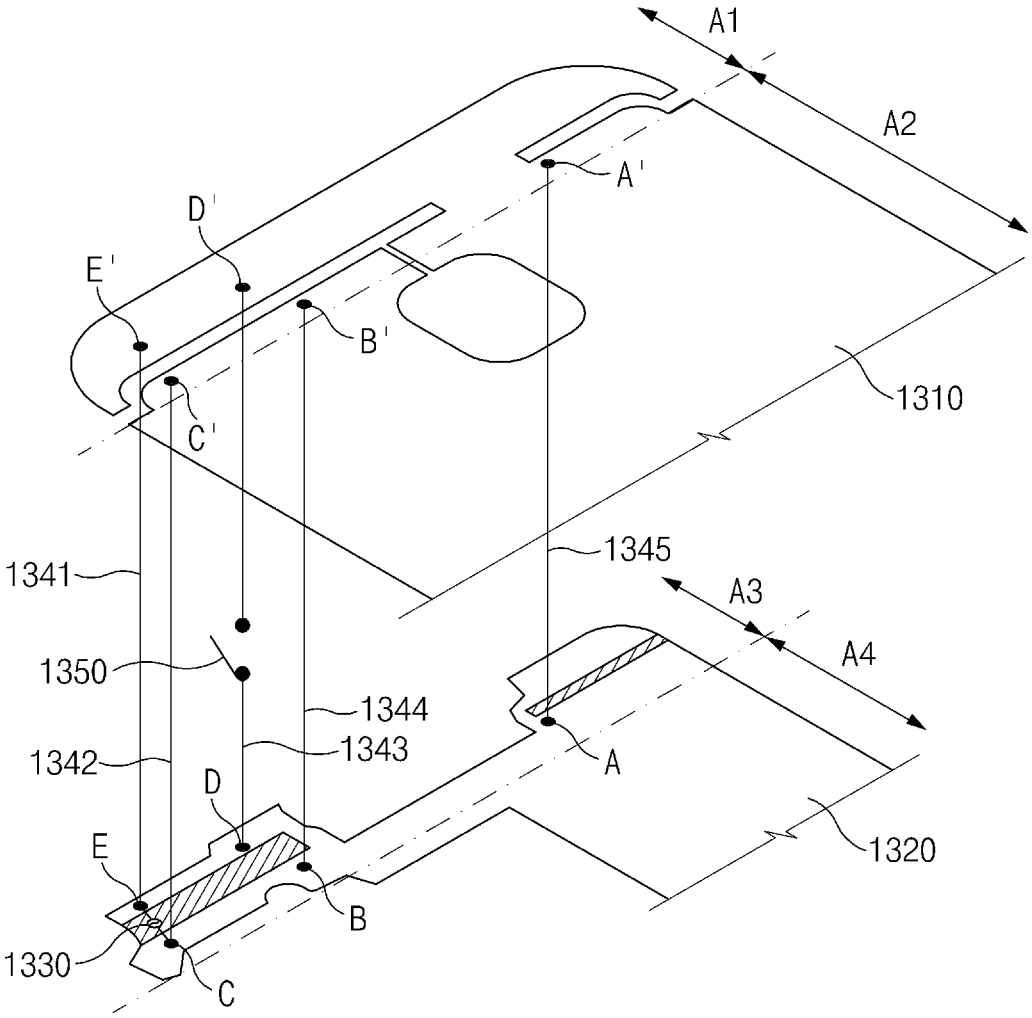
FIG. 13 illustrates a metal housing and a printed circuit board included in the electronic device according to an embodiment of the present disclosure.
Figure 14:
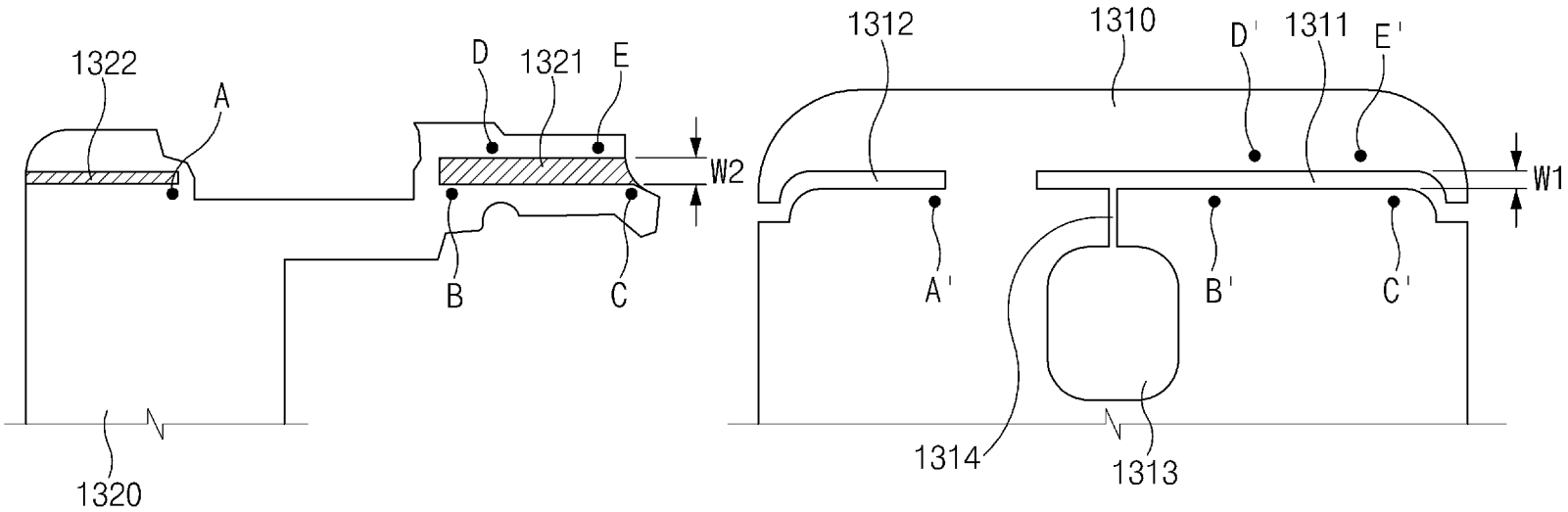
FIG. 14 illustrates the metal housing and the printed circuit board included in the electronic device according to an embodiment of the present disclosure.

FIG. 13 illustrates a metal housing and a printed circuit board included in an electronic device according to an embodiment of the present disclosure. FIG. 14 illustrates a metal housing and a printed circuit board included in an electronic device according to an embodiment of the present disclosure. For convenience, a description will be given with reference to FIGS. 13 and 14.

Referring to FIGS. 13 and 14, an electronic device may include a metal housing 1310 and a printed circuit board 1320.

The metal housing 1310 may be disposed to cover at least part of a rear surface of the electronic device. A first slot 1311 that extends toward the center of the metal housing 1310 from one end of the metal housing 1310 may be formed in the metal housing 1310. A second slot 1312 that extends toward the center of the metal housing 1310 from an opposite end of the metal housing 1310 may be formed in the metal housing 1310. A hole 1313 through which a camera module is exposed may be defined in the metal housing 1310. The hole 1313 may be connected with the first slot 1311 through a third slot 1314.

A printed circuit board 1320 may be disposed in parallel with the metal housing 1310. A first region 1321 of the printed circuit board 1320 that corresponds to the first slot 1311 of the metal housing 1310 may be formed by a nonconductive material. A second region 1322 of the printed circuit board 1320 that corresponds to the second slot 1312 of the metal housing 1310 may be formed of a nonconductive material. Each of the first region 1321 and the second region 1322 may be a fill cut region. As shown in FIGS. 13 and 14 each of the first region 1321 and the second region 1322 is formed by a nonconductive material. However, embodiments of the present disclosure may not be limited thereto. The first region 1321 and the second region 1322 of the printed circuit board 1320 may be regions removed by cutting.

A point "E" of the printed circuit board 1320 may be adjacent to the first region 1321. The point "E" may be electrically connected with a feeding part 1330. The point "E" may be connected with a (+) terminal of the feeding part 1330. A point "C" may be electrically connected with a ground plate (e.g., a bracket). The printed circuit board 1320 may be fed through the point "E". A point "A" and a point "B" of the printed circuit board 1320 may be electrically connected with the ground plate, respectively.

The point "E" of the printed circuit board 1320 may be electrically connected with a point E' of the metal housing 1310 through a first electrical path 1341. The point E' may be adjacent to the first slot 1311. The metal housing 1310 may be fed through the point "E", the first electrical path 1341, and the point E'. Although not illustrated in FIG. 13, a capacitor (about 100 pF) may be disposed in the first electrical path 1341 to prevent electric shock. The point "C" of the printed circuit board 1320 may be electrically connected with a point C' of the metal housing 1310 through a second electrical path 1342. The metal housing 1310 may be fed through the point "C", the second electrical path 1342, and the point C'.

A point "D" of the printed circuit board 1320 may be adjacent to the first region 1321. The point "D" of the printed circuit board 1320 may be electrically connected with a point D' of the metal housing 1310 through a third electrical path 1343. The point D' may be adjacent to the first slot 1311. A switch 1350 may be interposed in the third electrical path 1343. The switch 1350 may adjust making and breaking of the third electrical path 1343.

The point "B" of the printed circuit board 1320 may be adjacent to the first region 1321. The point "B" of the printed circuit board 1320 may be electrically connected with a point B' of the metal housing 1310 through a fourth electrical path 1344. The point B' may be adjacent to the first slot 1311. The metal housing 1310 may be grounded through the point "B", the fourth electrical path 1344, and the point B'.

The point "A" of the printed circuit board 1320 may be adjacent to the second region 1322. The point "A" of the printed circuit board 1320 may be electrically connected with a point A' of the metal housing 1310 through a fifth electrical path 1345. The point A' may be adjacent to the second slot 1312. The metal housing 1310 may be grounded through the point "A", the fifth electrical path 1345, and the point A'.

The above-described points "A", "B", "C", "D", and "E" may be electrically connected with the points A', B', C', D', and E' through connection members such as C-clips, respectively.

Each of the metal housing 1310 and the printed circuit board 1320 may operate as an antenna resonant element. A region A1 of the metal housing 1310 may be used as an antenna radiator. A region A2 of the metal housing 1310 may be grounded. A region A3 of the printed circuit board 1320 may be used as an antenna radiator. A region A4 of the printed circuit board 1320 may be grounded.

In the case of the printed circuit board 1320, an electrical signal fed to the point "E" may be radiated through an electrical path that passes the point "E", the point "D", the point "B", and the point "C".

In the case of the metal housing 1310, if the switch 1350 is turned off, an electrical signal fed to the point "E" may be transferred to the point E', and the electrical signal transferred to the point E' may be radiated through an electrical path that passes the point E', the point D', the point B', and the point C'. IA resonant frequency of the metal housing 1310 and the printed circuit board 1320 may be about 700 MHz to about 900 MHz.

In the case of the metal housing 1310, if the switch 1350 is turned on, an electrical signal fed to the point "E" may be transferred to the point D' through the point "D", and the electrical signal transferred to the point D' may be radiated through an electrical path that passes the point D', the point B', and the point C'. A resonant frequency of the metal housing 1310 and the printed circuit board 1320 may be about 800 MHz to about 1000 MHz.

As described above, the metal housing 1310 may resonate at a higher frequency band by using the third electrical path 1343 connecting the point "D" and the point D'. It may be possible to adjust a resonant frequency of the metal housing 1310 by interposing the switch 1350 in the third electrical path 1343.

The area of the first region 1321 of the printed circuit board 1320 may be wider than the area of the first slot 1311 of the metal housing 1310. A width W2 of the first region 1321 may be greater than a width W1 of the first slot 1311. The printed circuit board 1320 may operate as a loop antenna resonant element because of the first region 1321, and the metal housing 1310 may operate as a slot antenna resonant element because of the first slot 1311.

Figure 15:
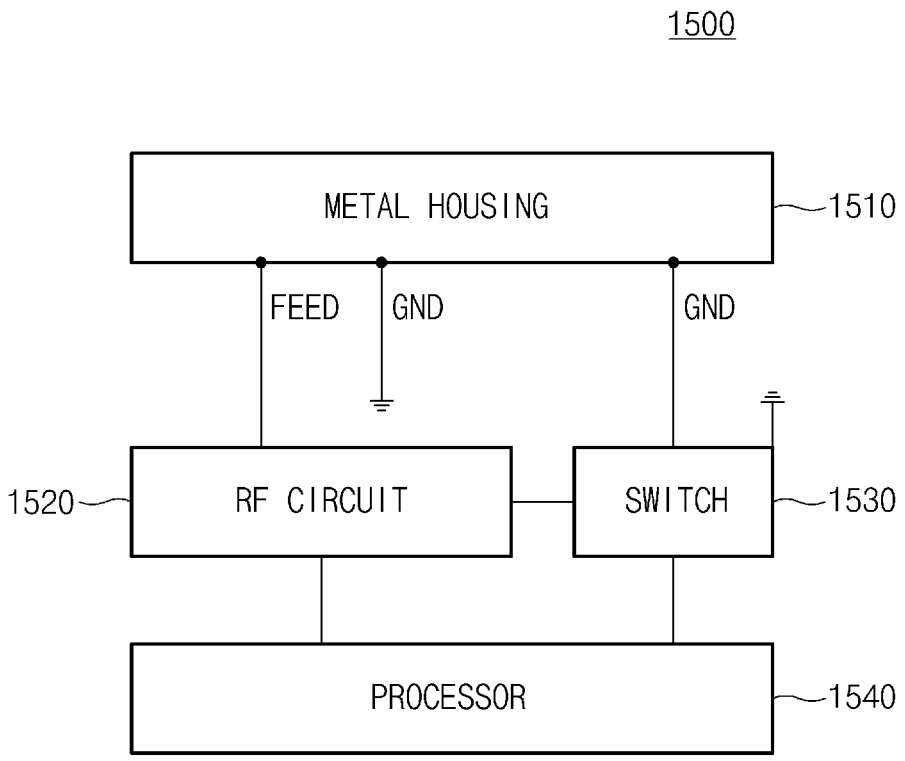
FIG. 15 is a block diagram illustrating a configuration of the electronic device according to an embodiment of the present disclosure.

FIG. 15 is a block diagram illustrating a configuration of an electronic device according to an embodiment of the present disclosure.

Referring to FIG. 15, an electronic device may include a metal housing 1510, an RF circuit 1520, a switch 1530, and a processor 1540.

The metal housing 1510 and the switch 1530 may be the same as the metal housing 1310 and the switch 1350 illustrated in FIG. 13.

The metal housing 1510 may be electrically connected with the RF circuit 1520 and the switch 1530. The metal housing 1510 may be fed through the RF circuit 1520. The metal housing 1510 may be grounded through the RF circuit 1520. The metal housing 1510 may be connected with the RF circuit 1520 through the switch 1530 or may be grounded through the switch 1530. A resonant frequency of the metal housing 1510 may be changed depending on an operation of the switch 1530. The resonant frequency of the metal housing 1510 may be about 700 MHz to about 1000 MHz.

The RF circuit 1520 may be electrically connected with the metal housing 1510, the switch 1530, and the processor 1540. The RF circuit 1520 may transfer an electrical signal to the metal housing 1510. The RF circuit 1520 may receive an electrical signal from the metal housing 1510. The RF circuit 1520 may include a transmitter (Tx) circuit, a receiver (Rx) circuit, or a transceiver (Tx/Rx) circuit.

The switch 1530 may adjust the making and breaking of an electrical path connecting the metal housing 1510 and the RF circuit 1520. The switch 1530 may be the switch 1350 illustrated in FIG. 13.

The processor 1540 may be a communication processor or an application processor. The processor 1540 may be electrically connected with the RF circuit 1520 and the switch 1530. The processor 1540 may transfer an electrical signal to the RF circuit 1520 and may receive an electrical signal from the RF circuit 1520. The processor 1540 may control the switch 1530.

According to an embodiment, the processor 1540 may control a switch based on a frequency band to be used. The processor 1540 may control the switch 1350 illustrated in FIG. 13. To use the relatively high frequency band, the processor 1540 may control the switch 1350 such that the switch 1350 is turned on. To use the relatively low frequency band, the processor 1540 may control the switch 1350 such that the switch 1350 is turned off.

The term "module" used in this disclosure may include a unit composed of hardware, software and firmware and may be interchangeably used with the terms "unit", "logic", "logical block", "component" and "circuit". The "module" may be an integrated component or may be a minimum unit for performing one or more functions or a part thereof. The "module" may be implemented mechanically or electronically and may include at least one of an application-specific IC (ASIC) chip, a field-programmable gate array (FPGA), and a programmable-logic device for performing some operations, which are known or will be developed. At least a part of an apparatus (e.g., modules or functions thereof) or a method (e.g., operations) according to various embodiments may be implemented by instructions stored in computer-readable storage media (e.g., the memory 130) in the form of a program module. The instruction, when executed by a processor (e.g., the processor 120), may cause the processor to perform a function corresponding to the instruction. A computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), and an internal memory. Also, a program instruction may include not only an assembly code such as things generated by a compiler but also a high-level language code executable on a computer using an interpreter. A module or a program module may include at least one of the above elements, or a part of the above elements may be omitted, or other elements may be further included. Operations performed by a module, a program module, or other elements may be executed sequentially, in parallel, repeatedly, or in a heuristic method or some operations may be executed in different sequences or may be omitted. Alternatively, other operations may be added.

According to embodiments of the present disclosure, it may be possible to improve radiation performance of an antenna resonant element adjacent to a metal housing by electrically connecting the antenna resonant element to a ground plate via a plurality of electrical paths.

It may be possible to adjust a resonant frequency of the antenna resonant element by disposing a switch on at least some of a plurality of electrical paths.

A variety of effects directly or indirectly understood through this disclosure may be provided.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a metal housing;

a conductive member disposed adjacent to the metal housing;

a plurality of ground parts including a first ground part electrically connected with a first point of the conductive member, a second ground part, and a third ground part;

a ground plate electrically connected with the metal housing and the plurality of ground parts, and electrically connected with the conductive member via the first ground part and one of the second ground part or the third ground part;

a feeding part electrically connected with the conductive member; and at least one switch configured to connect a second point of the conductive member to the second ground part or to the third ground part, wherein the second ground part includes a capacitive element and the third ground part includes an inductive element, and wherein an electrical length of the second ground part is different from an electrical length of the third ground part.

2. The electronic device of claim 1, wherein the feeding part is electrically connected with the conductive member via one of the first point of the conductive member and the second point of the conductive member.

3. The electronic device of claim 1, further comprising:

a capacitor electrically connected with the metal housing and the ground plate.

4. The electronic device of claim 1, wherein the metal housing is disposed to cover at least part of a rear surface of the electronic device.

5. The electronic device of claim 1, wherein the conductive member is disposed to cover at least part of a side surface of the electronic device.

6. The electronic device of claim 1, wherein each of at least some of the plurality of ground parts includes a lumped element.

7. The electronic device of claim 1, further comprising:

a nonconductive member interposed between the metal housing and the conductive member to allow the conductive member to be spaced apart from the metal housing.

8. The electronic device of claim 1, wherein the ground plate is disposed within a space defined by the metal housing and the conductive member.

9. The electronic device of claim 1, further comprising a processor electrically connected with the at least one switch, wherein the processor is configured to control the at least one switch based on a frequency band to be used.

10. The electronic device of claim 1, wherein the at least one switch comprises:

a first switch disposed on the second ground part and configured to adjust making and breaking of the second ground part; and a second switch disposed on the third ground part and configured to adjust making and breaking of the third ground part.

11. An electronic device comprising:

a metal housing;

a nonconductive member being in contact with the metal housing;

a conductive member being in contact with the nonconductive member, spaced apart from the metal housing by the nonconductive member, and electrically coupled with the metal housing;

a plurality of ground parts including a first ground part electrically connected with a first point of the conductive member, a second ground part, and a third ground part;

a ground plate electrically connected with the metal housing and the plurality of ground parts, and electrically connected with the conductive member via the first ground part and one of the second ground part or the third ground part; and a feeding part electrically connected with the conductive member; and at least one switch configured to connect a second point of the conductive member to the second ground part or to the third ground part, wherein the second ground part includes a capacitive element and the third ground part includes an inductive element, and wherein an electrical length of the second ground part is different from an electrical length of the third ground part.

12. An electronic device comprising:

a metal housing in which a slot is formed;

a printed circuit board disposed in parallel with the metal housing, wherein a partial region of the printed circuit board corresponding to the slot being formed of a nonconductive material;

a plurality of electrical paths including a first electrical path, a second electrical path, and a third electric path, wherein the first electrical path connects a first point of the printed circuit board adjacent to the partial region and a first point of the metal housing adjacent to the slot, the second electrical path connects a second point of the printed circuit board adjacent to the partial region and a second point of the metal housing adjacent to the slot, and the third electrical path connects a third point of the printed circuit board adjacent to the partial region and the second point of the metal housing;

a switch configured to adjust making and breaking of the second electrical path or the third electrical path;

a ground plate electrically connected with the metal housing and the printed circuit board; and a feeding part electrically connected with the second point of the printed circuit board, wherein the second electrical path includes a capacitive element and the third electrical path includes an inductive element, and wherein an electrical length of the second electrical path is different from an electrical length of the third electrical path.

13. The electronic device of claim 12, wherein each of the metal housing and the printed circuit board is an antenna resonant element.

14. The electronic device of claim 12, wherein an area of the partial region of the printed circuit board is wider than an area of the slot of the metal housing.

15. The electronic device of claim 14, wherein the printed circuit board is a loop antenna resonant element, and the metal housing is a slot antenna resonant element.

16. The electronic device of claim 12, wherein the metal housing is disposed to cover at least part of a rear surface of the electronic device.

* * * * *